United States Patent [19]

Elstein et al.

[11] Patent Number: 4,834,375

[45] Date of Patent: May 30, 1989

[54] START SYSTEM BATTING UNIT AND METHOD

[75] Inventors: Rick A. Elstein, Melville; Svein Faret, Plainview; Larry E. Mayol, Glen Cove, all of N.Y.

[73] Assignee: Innovative Training Products, Inc., Syosset, N.Y.

[21] Appl. No.: 120,913

[22] Filed: Oct. 26, 1987

Related U.S. Application Data

[63] Continuation-in-part of Ser. No. 890,716, Jul. 25, 1986, Pat. No. 4,702,475, which is a continuation-in-part of Ser. No. 766,913, Aug. 16, 1985, abandoned.

[51] Int. Cl.[4] ..... A63B 69/00; A63B 69/38

[52] U.S. Cl. ..... 273/26 R; 273/1 GC; 273/1 GE; 273/29 A

[58] Field of Search ..... 273/26 R, 26 A, 26 B, 273/88, 181 H, 181 E, 183 R, 183 A, 186 R, 186 B, 186 C, 186 RA, 1 GC, 1 GE, 29 A; 434/247; 340/323

[56] References Cited

U.S. PATENT DOCUMENTS

| | | | |
|---|---|---|---|
| 4,058,113 | 11/1977 | Fields . | |
| 4,166,452 | 9/1979 | Generales, Jr. . | |
| 4,445,685 | 5/1984 | Cardieri | 273/26 R |
| 4,461,477 | 7/1984 | Stewart | 273/26 R |
| 4,534,557 | 8/1985 | Bigelow et al. . | |
| 4,577,868 | 3/1986 | Kiyonaga | 273/26 R |

FOREIGN PATENT DOCUMENTS 2950408 12/1979 Fed. Rep. of Germany .

*Primary Examiner*—Maryann Lastova
*Attorney, Agent, or Firm*—Scully, Scott, Murphy & Presser

[57] ABSTRACT

An improved method and apparatus for technique and accelerated reaction training of a batter in a batter training program. In the arrangement, a plurality of different batting reaction patterns to be executed by the batter are defined by the selective energization of one of an array of lights positioned visibly in front of the batter. Each light signifies a different particular batting reaction pattern to be executed by the batter. At least one and preferably two batting tees are positioned with respect to an indicated home plate in front of the batter, such that the batter addresses home plate during the batter training program. Each batting tee has one light of the light array associated therewith, such that when a particular light associated with a particular batting tee is energized, the batter reacts by attempting to bat the ball off of that particular batting tee within a given programmed time period. The system determines whether the actual time period of batting response from the energization of the light to the hitting of the ball off of the batting tee is within the programmed time period. The system then activates an acoustic transducer at the end of the programmed time period to audibly signal to the batter whether or not he has hit the ball off of the tee within the programmed time period. A first frequency sound tone is generated when the batter hits the ball off of the tee within the programmed time period, and a second, lower frequency sound tone is generated when the batter fails to do so.

14 Claims, 30 Drawing Sheets

BATTING TEE, SENSOR, SMART BATTING UNIT

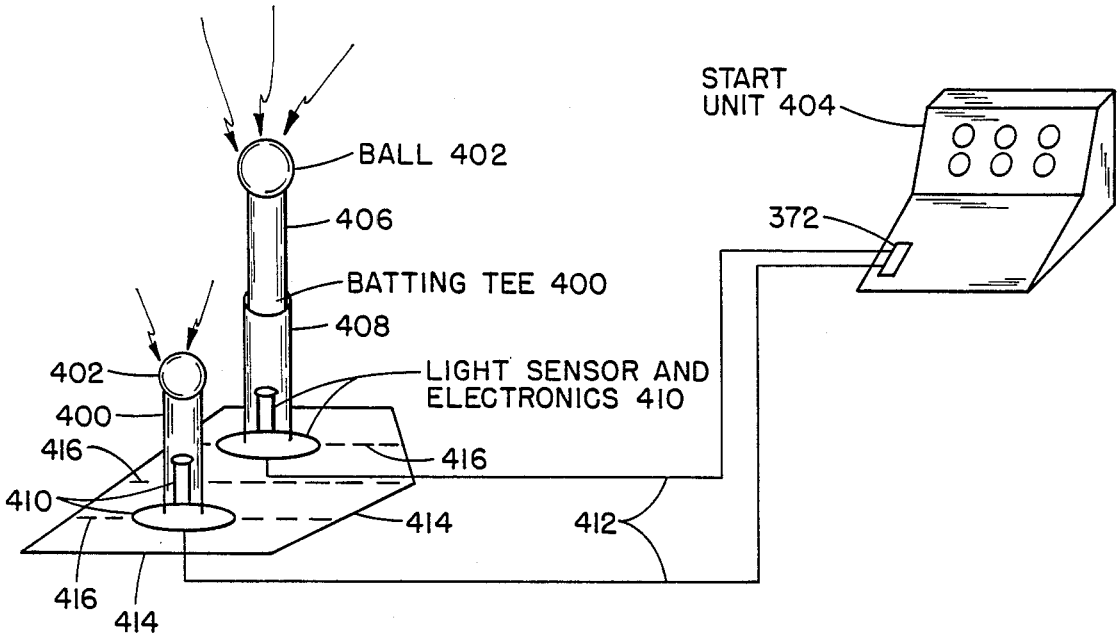
FIG. 36 BATTING TEE, SENSOR, SMART BATTING UNIT
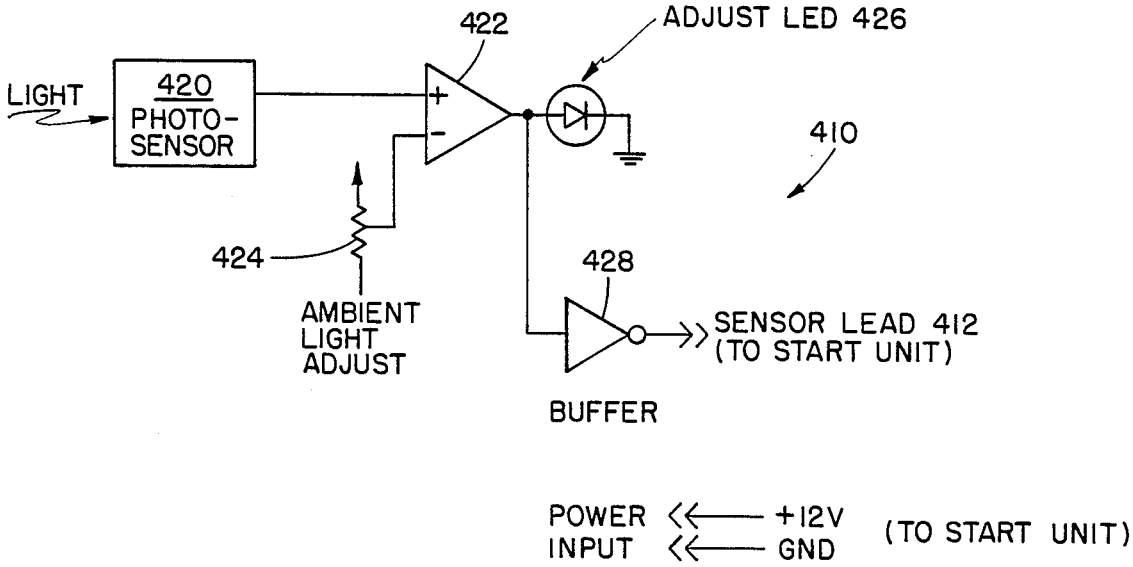
FIG. 37 LIGHT SENSOR BLOCK DIAGRAM

START SYSTEM BATTING UNIT AND METHOD

This patent application is a continuation-in-part application of patent application Ser. No. 890,716, filed July 25, 1986, now U.S. Pat. No. 4,702,475 for Sports Technique And Recreation Training System, which is a continuation-in-part application of patent application Ser. No. 766,913, filed Aug. 16, 1985 for Apparatus For Accelerated Reaction Training, now abandoned.

BACKGROUND OF THE INVENTION

1. Field of the Invention

The present invention relates generally to a batting unit designed for use with a Sports Technique And Reaction Training (START) system, which is a highly sophisticated training system with programming capabilities designed particularly for improving, progressing, and testing the development pattern of skilled motor functions (engrams) in sports, particularly with respect to baseball hitting skills, rehabilitation, and health and fitness. In the field of rehabilitation in particular, the subject invention should prove valuable and have particular utility in providing measured objective evidence of recovery of a batter from an injury. This is particularly useful in professional sports in gauging the ability of an injured player to perform under competitive situations, and also has utility in legal situations involving compensation, for example, in cases involving an injured employee or worker.

In the fields of sports, rehabilitation, health and fitness, a person frequently performs particular motor movements to achieve a specific purpose, such as for example the motor movements performed during execution of a backhand stroke in tennis. It is primarily in the sensory and sensory association areas that the athlete experiences the effects of such motor movements and records "memories" of the different patterns of motor movements, which are called sensory engrams of the motor movements. When the athlete wishes to perform a specific act, he presumably calls forth one of these engrams, and then sets the motor system of the brain into action to reproduce the sensory pattern that is engrained in the engram.

Even a highly skilled motor activity can be performed the very first time if it is performed extremely slowly, slowly enough for sensory feedback to guide the movements through each step. However, to be really useful, many skilled motor activities must be performed rapidly. This is capable of being achieved by successive performance of the skilled activity at game speed using the START system of the present invention until finally an engram of the skilled activity is engrained in the motor system as well as in the sensory system. This motor engram causes a precise set of muscles to perform a specific sequence of movements required for the skilled activity.

Most types of Inter partes competitive athletic performance involve predetermined patterns of sequenced muscle performance, usually in response to an act of an opponent, and the proficiency level of such performance is usually dependent, at least in large part, upon the reaction time required to initiate a predetermined pattern of sequenced muscle performance in response to an opponent's act and the rapidity with which such predetermined pattern is carried out. A corollary of the foregoing is the physical conditioning of the various muscles and other interrelated body components involved in each such predetermined pattern of muscle performance to minimize, if not substantially avoid, injury in the performance thereof.

2. Discussion of the Prior Art

The following U.S. patents are considered somewhat pertinent to the present invention as disclosing concepts related in some respects to the subject START system batting unit. However, none of the cited prior art discloses a system having the versatile attributes of the SPORTS system batting unit as disclosed herein.

Goldfarb et al. U.S. Pat. No. 3,933,354 discloses a marshall arts amusement device having a picture, such as a display of a combatant, which is adapted to be struck by a participant, a series of lights mounted behind the picture, preferably each located at a different key attack or defensive position on the body of the combatant. The display detects when the picture is struck in the vicinity of a light, and is responsive to the detection for illuminating one of the lights and for controlling which light in the series is next illuminated when the picture is hit. In order to demonstrate high performance or win against an opponent, the participant must rapidly extinguish each light in the series by touching or hitting the picture at the illuminated light. The lights are illuminated in a pseudo-random order which the participant cannot anticipate, and therefore his relaxation, coordination, balance and speed are tested much the same as they would be in combat in determining the quality of his performance.

Hurley U.S. Pat. No. 4,027,875 discloses a reaction training device which includes a pair of spaced apart, electrically connected stands, each being provided with electrical switch boxes. Each of the switch boxes is provided with an external plunger, with the plunger being connected to electrical circuitry and acting as a switch. A timer is connected to the electrical circuitry, such that that the time required for a person to activate the timer by touching the plunger on one switch box and stop the timer by touching the plunger on the other switch box is recorded.

Groff U.S. Pat. No. 4,493,655 discloses a radio controlled teaching system in which a portable, self-powered, radio-controlled teaching device is provided for each student of a classroom, such that the teacher maintains a high level of student alertness by remaining in radio contact with each and every student during selected periods of the classroom day. A teaching device electronically transmits teacher-selected data to each student which, in turn, requires individual student responses to the data without the necessity of wired connections between the teacher and students. The teaching device is used to instantly and extemporaneously test the students in the class on a selected subject area.

Bigelow et al. U.S. Pat. No. 4,534,557 discloses a reaction time and applied force feedback training system for sports which includes at least one sports training device, and a stimulus indicator located near and associated with the sports training device. The stimulus indicator generates a plurality of ready signals at random time intervals, and a sensor in the sports training device is receptive of a force applied to the sports training device for generating an electrical signal having a magnitude proportional to the magnitude of the applied force. A control unit controls the emanation of the ready signals, and determines and displays the reaction time from emanation of the ready signal to sensing the applied force, along with the magnitude of the applied force.

In summary, none of the aforementioned prior art provides an integrated START system having the general applicability and versatility of the subject invention with its many significant attributes as described in greater detail hereinbelow.

SUMMARY OF THE INVENTION

Accordingly, it is a primary object of the present invention to provide a training system which will enhance and improve the reflex capabilities of amateur and professional batters with a unique training program that advances the state of the art in batter training and practice The START system of the present invention trains an individual batter in actual game situations using the identical movements that are necessary and at the same speed required by the sport. By training the actual movements necessary for the sport, the specificity of training is tremendously improved in the following areas: quicker reaction to outside stimulus and response with proper technique; aerobic-anaerobic fitness; strength; power; agility; balance and endurance. The specificity of training is very high because the athlete is motivated by competing against a measured period of time to perform at maximum levels on each movement in order to perform within the measured time period, which is analagous to a victory over an opponent.

The present invention may be briefly described as an improved method and apparatus for technique and accelerated reaction training of a batter in a batter training program. In the arrangement, a plurality of different batting reaction patterns to be executed by the batter are defined by the selective energization of one of an array of lights positioned visibly in front of the batter. Each light signifies a different particular batting reaction pattern to be executed by the batter, and at least one of the batting reaction patterns is to be executed in a given programmed time period. For instance, with the three stop lights of the array being energized by the program, the following different batter reaction patterns can be signified by the lights:

1. Top left-swing at the ball placed on the tee closest to a righthanded batter;
2. Top right-swing at the ball placed on the tee furthest from a righthanded batter; and
3. Middle-back away from the pitch as if a "knockdown" pitch were thrown.

The batter is provided with at least one batting tee positioned with respect to an indicated home plate, such that the batter can address the indicated home plate and a ball placed on the batting tee during the batter training program. In some training programs, only one variable height batting tee need be utilized. However, in more complex training programs two variable height batting tees are provided for the batter, with each batting tee being positioned differently with respect to the indicated home plate. Each batting tee has one light of the light array associated therewith, such that when a particular light associated with a particular batting tee is energized, the batter reacts by attempting t bat the ball off of that particular batting tee.

During the batter training program, one light of the array is energized at a time, signifying a particular batter reaction pattern to be executed, in a sequence of energizing of the array of lights unknown to the batter undertaking the batter training program. Moreover, the sequence of lighting of the array appears to be random to the batter, such that the batter waits for an unknown light to be energized, and then reacts with a particular batter reaction pattern to be executed. At least one of the batter reaction patterns to be executed is the hitting of a ball placed on the batting tee within a programmed time period. The system determines whether the actual time period of batting response from the energization of the light to the hitting of the ball off of the batting tee is within the programmed time period. The system then selectively activates an acoustic transducer at the end of the programmed time period to audibly signal to the batter whether or not he has hit the ball off of the tee within the programmed time period. The selective octivation could be simply either the energization or not of the acoustic transducer at a single frequency. In a preferred embodiment, the acoustic transducer is activated with a first sound tone when the batter hits the ball of the tee within the programmed time period of response, and is activated with a second, different frequency sound tone when the batter fails to hit the ball off of the tee within the programmed time period.

Furthermore, in a preferred batter training program a trainer is positioned in front of the batter behind the START light array, preferably behind a protective net or shield. The trainer simulates a pitcher and also activates a remote START switch during the pitching wind-up to energize one light of the array of lights.

Moreover, in a preferred embodiment the time of hitting of a ball off of the tee is detected by a photosensor positioned with an opaque batting tee. The photosensor detects the ambient light incident thereon in response to the ball being hit off of the tee to detect the moment of hitting of the ball. Moreover, an adjustment is also provided t adjust the sensitivity of the photosensor to ambient light.

In a preferred embodiment the START system is preferably constructed and provided in a portable carrying case, wherein the array of lights is mounted in the top portion of the carrying case, and the control system therefor is located in the bottom portion.

A preferred embodiment of the present invention has been developed wherein the control system is a microprocessor programmed and operated control system. In this embodiment, the microprocessor is coupled to an address bus, a control bus, and a data bus, and each of the array of lights, as well as additional controlled features, is coupled to and controlled by the microprocessor by signals issued on the address bus, the control bus, and the data bus.

The batting training program can be stored in a specially designed START system having the necessary programs for the batting unit already in memory, for instance in firmware in the unit. Alternatively, a batting program can be stored in an external memory of an XROM cartridge which is insertable into a port in the bottom portion of the carrying case. Moreover, the cartridge can contain several different training programs stored in memory with different sequences of lights.

Advantageously, a cartridge can be programmed with a weakness drill program wherein at least one particular light in the array of lights is energized more frequently than other lights, with that particular light signifying a weakness movement pattern to be executed by the person, such that the program works on strengthening a particular weakness movement pattern. The system is also preferably programmed to provide a warm-up program which is run prior to the training program and a cool-down program which is run after the training program.

Moreover, in a preferred embodiment the microprocessor operated control system is programmable by a keypad entry array of keys in the bottom portion of the carrying case, which includes a keypad entry display for displaying the entries being made into the system. In this system, the individual time periods of response for each light stored in memory are changeable and reprogrammable by operation of the keypad entry array, particularly to suit the development and training of the person undertaking the training program. Advantageously, a percentage faster key is provided on the keypad entry array to actuate a routine to change the time periods of response in the program to make them a given percentage of time faster, and a percentage slower key is also provided to actuate a routine to change the time periods of response in the program to make them a given percentage of time slower.

In a preferred embodiment, at least one transducer is coupled to the control system which is activated by the person at the end of the particular movement pattern being executed, and the control system measures the actual period of time taken by the person to activate the transducer, and stores each measured time period of actual response in memory.

One advantageous feature of the present invention is the ability to obtain a print out from the computer memory of the performance of the person in the program. The print out can include the individual measured response times, averages thereof, plotted curves thereof, and additional displays of the response data stored in memory.

A preferred embodiment of the subject invention also incorporates therein voice synthesizer circuits for instructing the person on correct operation of the system, and also during the training program.

Another advantage of the subject invention is the enhancement of performance and results obtainable in a physical therapy program designed particularly for athletes desirous of returning to competitive activity following an injury or other physical disablement, as well as for enhanced general physical conditioning. Still other advantages of the practice of the subject invention are the development of improved cardio-vascular fitness, improved reaction times, improved balance, agility and speed, as well as an enhanced resistance to injury in the performance of athletic functions, and enhanced recovery from injury resulting from athletic or related physical endeavors.

BRIEF DESCRIPTION OF THE DRAWINGS

The foregoing objects and advantages of the present invention for a START system batting unit may be more readily understood by one skilled in the art, with reference being had to the following detailed description of several preferred embodiments thereof, taken in conjunction with the accompanying drawings wherein like elements are designated by identical reference numerals throughout the several views, and in which:

FIGS. 12 through 33 ar logic flow diagrams illustrating the primary logic flow steps of the program for the microprocessor, in which:

FIGS. 12 through 16 illustrate the programming steps involved in the initialization of the unit after it is initially turned on;

FIG. 17 illustrates the programming sequence of the main operational running loop which allows an operator to select a drill and set up the parameters governing the operation thereof, and the middle of FIG. 17 refers to the four state routines of the system, the three more complicated of which are illustrated in FIGS. 25 through 27, and the right side of FIG. 7 refers to thirty-one different routines, the more complicated of which are illustrated in FIGS. 28 through 35;

FIG. 18 illustrates handling of the interrupt and background routines which are performed every 0.01 seconds;

FIGS. 19 through 24 illustrate the interrelated logic flow diagrams of the interrupt and background routines performed every 0.01 seconds; in which FIG. 19 illustrates the logic flow diagram of the input and output subroutine which keeps track of all inputs and outputs of the system;

FIGS. 20 and 21 are logic flow diagrams of the timing functions and counters of the processor;

FIG. 22 is a logic flow diagram of the LED display drive and keyboard matrix scanner operations;

FIGS. 23 and 24 illustrate the logic flow diagrams of the key detection and debouncing routines;

FIGS. 25 through 27 illustrate the logic flow diagrams of the three state routines of the system, including the numeric display routine of FIG. 25, the modify display routine of FIG. 26, and the drill running routine of FIG. 27, which state routines are illustrated in the central portion of the main operational loop of FIG. 17;

FIGS. 28 through 35 illustrate the logic flow diagrams of the more complicated of the thirty-one routines shown on the right portion of the main operational loop of FIG. 17, including the start routine of FIG. 28, the program routine of FIG. 29, the beginner routine of FIG. 30, the number of routine of FIG. 31, the modify routine of FIG. 32, the duration routine of FIG. 33, the cancel warm-up routine of FIG. 34, and the enter routine of FIG. 35;

FIG. 36 illustrates a basic START system batting unit with several batting tees positioned relative to a designated home plate, and also illustrates the photosensor circuits for detecting the hitting of a baseball off each tee;

FIG. 37 illustrates a block diagram of a photosensor circuit, and an adjustment provided for adjusting the sensitivity of the circuit to ambient light.

DETAILED DESCRIPTION OF THE DRAWINGS

Most competitive athletic performances against an opponent, such as for example in tennis, football, soccer, basketball, hockey and baseball involve a specific repertoire of a relatively few basic patterns of movement, the rapidity of initiation and performance of which are significant factors in an athlete's competitive effectiveness. Each such pattern of movement normally involves a predetermined pattern of sequenced muscle performance to attain the desired result. For example, it has been observed that successful tennis players have developed a specific repertoire of movement patterns, each comprised of a few basic and very rapid movements and shots which place the player and the ball precisely where they can be most competitively effective. It has been observed further that the basic movement patterns are remarkably similar among the top successful tennis players. Similar movement patterns are also ascertainable for particular participants in other competitive sports endeavors. Instances where pronounced patterns of movement are readily ascertainable include football players, and particularly defensive backs, goalies and defensemen in hockey, basketball players, and baseball players, where good fielders have always been recognized as those who "get a good jump on the ball".

The methods hereinafter described are generally directed to accelerated reaction training, and in particular to the training of athletes to adapt and become increasingly proficient in such basic movement patterns through the utilization of randomly generated stimuli signals coupled with movement pattern responsive indicia to provide immediate positive or negative reinforcement for properly or improperly executed movements or patterns thereof.

Figure 1:
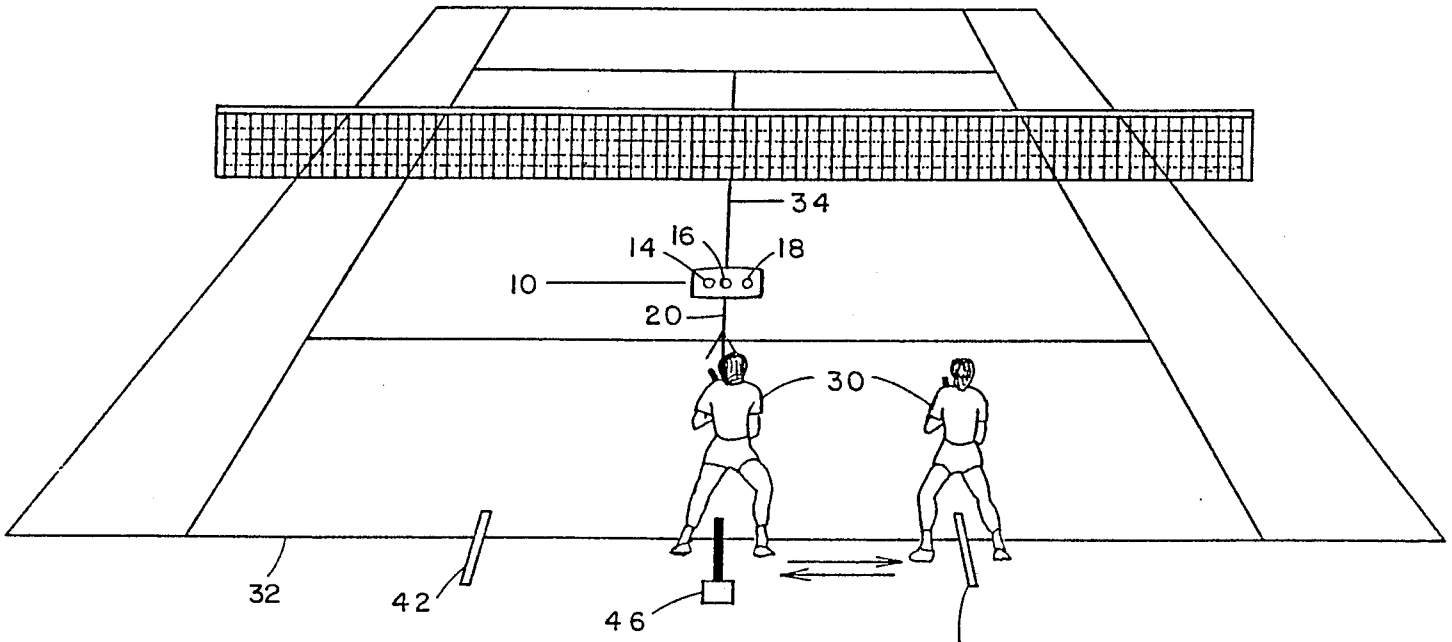
FIG. 1 is a schematic perspective view illustrating the employment of the methods of the START system in the training of tennis players.
Figure 2:
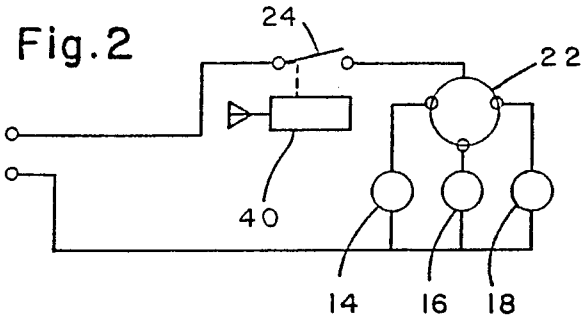
FIG. 2 is a schematic circuit diagram for the stimuli battery depicted in FIG. 1.

FIG. 1 is illustrative of the practice of the START system in enhancing the performance of an athlete in a basic side to side movement pattern such as is commonly employed in tennis. Such side to side movement involves a predetermined pattern of sequenced muscle performance. In order to enhance both a player's reaction time and the rapidity of performance, there is provided a stimuli battery, generally designated 10, positioned on the court center line and in view of the player 12. The stimuli battery 10 contains three lamps 14, 16 and 18 mounted in horizontal array on a support 20. As shown in FIG. 2, the lamps 14, 16 and 18 are adapted to be sequentially and repetitively individually energized by a continuously operating cyclic switch 22 included in the energized circuits therefor. However, such lamps will remain in an unlit condition due to the presence of a normally open and remotely operable switch 24 in the power circuit.

In the practice of the START system, an athlete 30 positions himself on the baseline 32 in generally straddle relationship with the center line 34. In a simple version thereof, the athlete 30 may initiate the drill by manual operation of a trigger transmitter of the type conventionally employed to trigger garage door opening devices. A receiver element 40 is associated with the switch 24 and, upon receipt of a signal from the trigger transmitter, operates to close the switch 24. Upon such remotely initiated closure of the switch 24, the power circuit is completed and the particular lamp whose energizing circuit is then closed or is the next to be closed by the operation of the cyclically operable switch 22 will light. As will now be apparent, however, activation by the trigger transmitter by the player 30 will result in a purely random selection of one particular lamp to be lit, thus precluding conscious or subconscious anticipation of a movement direction by the player.

In the above described example, the athlete 30 initiates the drill by activation of the transmitter trigger. The stimuli battery 10 responds immediately to the trigger signal by illuminating a randomly selected one of the plurality of lights 14, 16 or 18. The outermost lights, for example 14 and 18, correspond to different movement pattern directions, for example, movement pattern to the left and movement pattern to the right. There is preplaced in each such direction a mark 42 and 44 upon a ground surface located a finite distance from the centerline starting position 34. When, for example, light 18 illuminates, the athlete 30 moves through a predetermined pattern of movement to mark 44 and upon there arriving, immediately reverses direction and returns to the starting position. If desired, the lamp energizing circuits may be designed to maintain lamp illumination for a predetermined but selectable period of time within which the particular movement pattern should be completed.

As will now be apparent, use of the transmitter trigger by the athlete 30, although providing for random light selection, permits the athlete to train at his own pace. On the other hand, the transmitter trigger could also be held by an instructor, who can then control the pace of the drill as well as observe, and correct where necessary, the movement patterns being employed by the player during the drill. Repetitive drills in accord with the foregoing will improve both the athlete's reaction time and rapidity of performance by the particular movement pattern through enhanced sequenced muscle performance and, in addition, will function to condition the muscles involved therein.

If desired, the transmitter trigger may be dispensed with and the stimuli battery 10 actuated by a photosensor unit 46. Such photosensor unit 46 may be placed behind the baseline 32 coaxially with the centerline 34. In this instance, the athlete 30 initiates the drill by physical interposition in the path of the photocell sensor beam. Operation is as described hereinabove except that the system automatically recycles each time the athlete 30 returns to the base line starting position.

Figure 4:
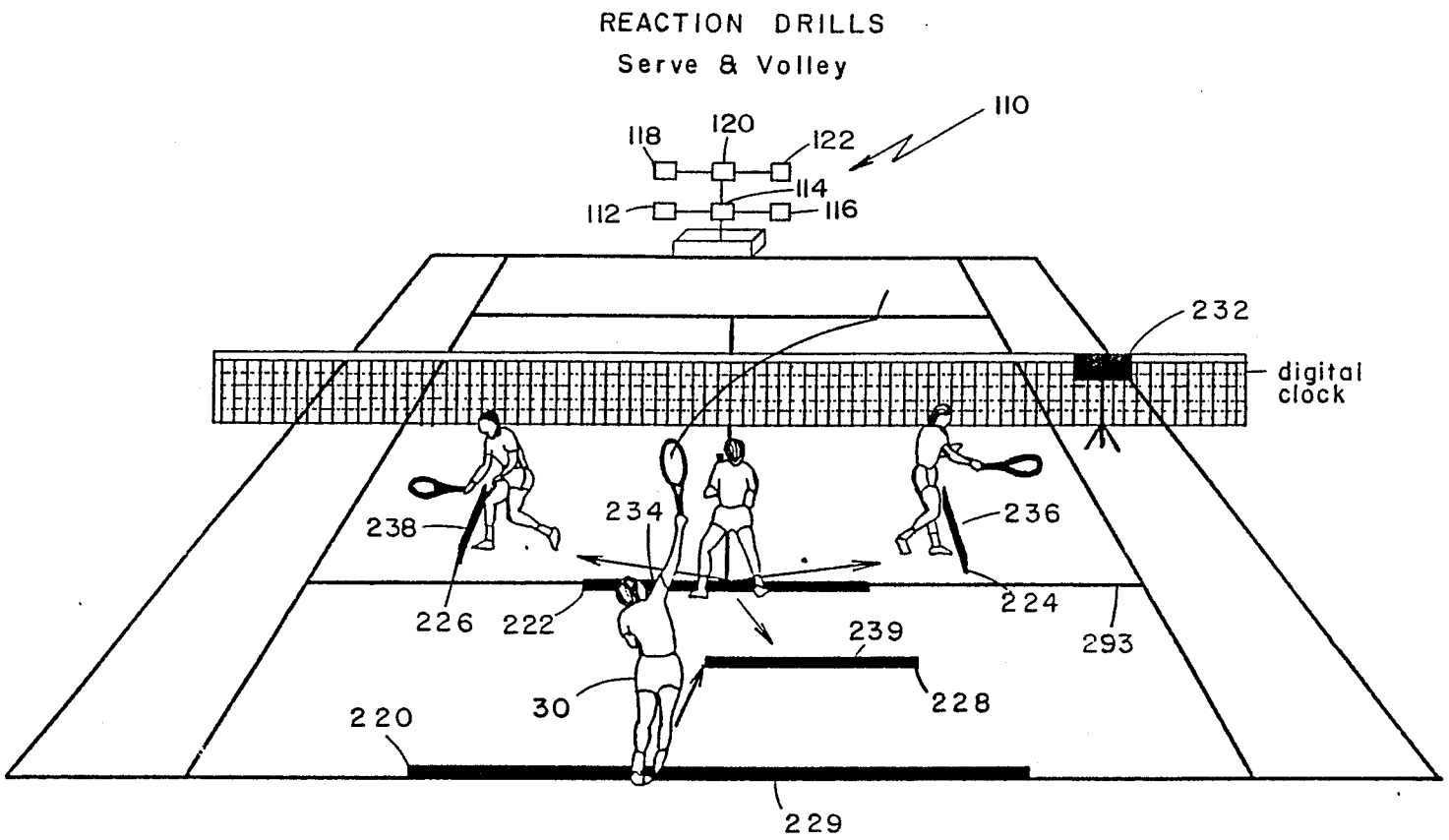
FIG. 4 is a schematic perspective view illustrating the employment of the programs of the START system in the training of more advanced tennis players.

Referring now to FIG. 4, there is illustratively provided a preferred multipurpose stimuli battery, generally designated 110, in the form of a plurality of lamps 112, 14, 116, 118, 120 and 122 mounted in a generally rectangular array on a support structure 124 above a base 26. Included within the base 126 is a power supply 128 connectable to any convenient source of electricity, not shown, through a line plug 130. Also included within the base 126 is a normally open and remotely operable switch 132 disposed intermediate the power supply 127 and a continuously operating cyclic switch 134 which sequentially completes individual energizing circuits for the lamps 112, 114, 116, 118, 120 and 122. In the operation of the described unit, the continuously operating cyclic switch 134 selectively and sequentially completes the energizing circuits for the lamps. However, such lamps will remain in an unlit condition due to the presence of the normally open and remotely operable switch 132. Activation of the switch 132 may be effected, for example, by a manually operable trigger transmitter 136, such as a transmitter of the type conventionally employed to trigger garage door opening devices or by a photocell response or the like. Upon such remotely initiated operation of the switch 132, a power circuit is completed between the power supply 128 and the particular lamp whose energizing circuit is either then closed or is the next to be closed by the operation of the cyclically operable switch 134. As will be apparent, activation of the trigger transmitter 136 results in a purely random selection of one particular lamp to be lit, dependent upon the status of the cyclic switch 134 at the time of transmitter activation.

As will now be apparent, the stimuli battery illustrated in FIG. 4 can provide a plurality of randomly selected action signals. For example, and assuming the user is facing the battery 110, ignition of lamp 116 can initiate a predetermined movement pattern to the right as indicated by the arrow 116*a*, FIG. 3. Similarly, selective ignition of lamps 118 and 122 can be employed to initiate diagonal movement patterns, while selective ignition of lamps 114 and 120 can be employed to initiate backward and forward movement patterns respectively. As will now also be apparent, elevation or jumping patterns could also be initiated by single or combinational lamp energization.

Figure 3:
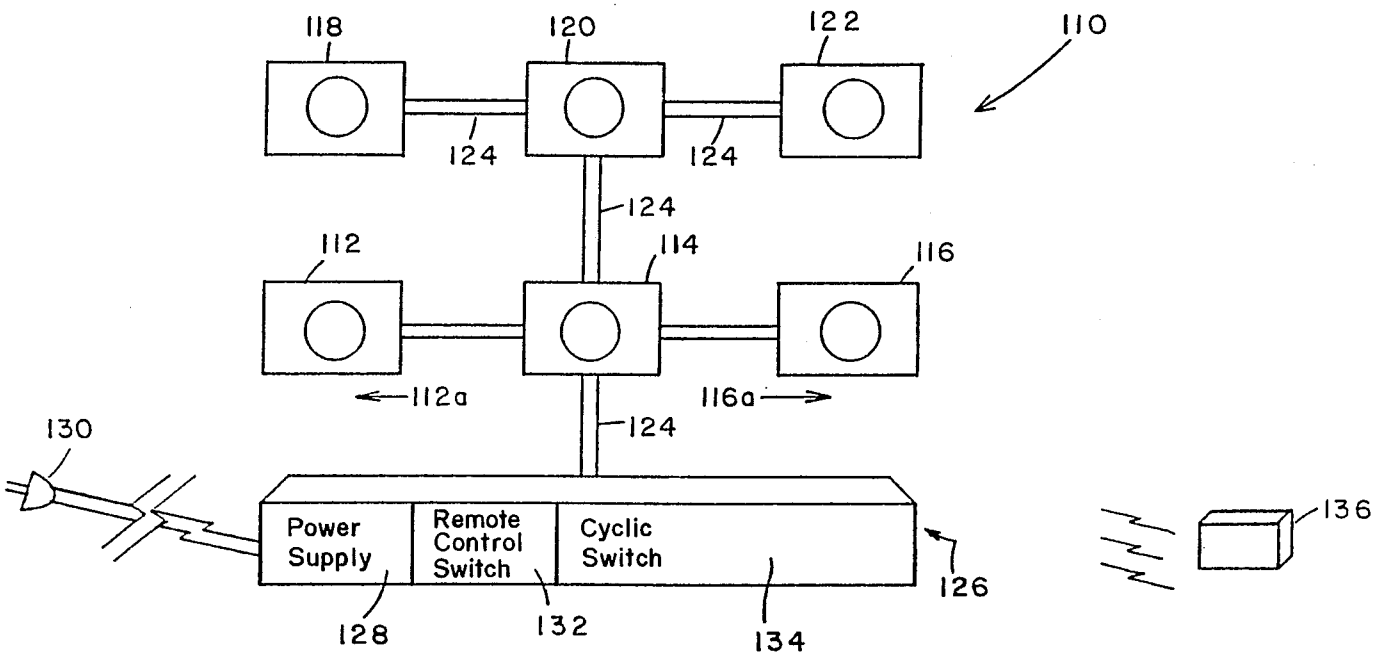
FIG. 3 is an elevational view of a stimuli battery for providing a visual indication of a desired type of movement by a subject.

FIG. 4 illustrates another and more complicated tennis drill employing the stimuli battery shown in FIG. 3 and described above. In this drill, the stimulis battery means 110 comprises the previously described six lights 112, 114, 116, 118, 120 and 122, again placed within view of the athlete on the far side of the court. Stimuli battery means 110 is here electronically coupled to a plurality of photosensor means 220, 222, 224, 226, and 228, and to an electronic clock 232. The athlete 30 can initiate the drill by serving the ball and moving netward through the zone of focus 229 of a first photosensor means 220, with the zone of focus 229 being proximate to and substantially parallel to the usual location of the tennis court service line 293 along the central segment thereof. The stimuli battery 110 responds to the movement of the athlete through the second zone of focus 234 by selecting and illuminating one light of the available plurality thereof. In this embodiment lamps 118 and 122 would direct movement toward additional focus zones 236 and 238, respectively. Each light corresponds to one of a plurality of additional zones of focus, i.e.; light 120 for moving forward, light 114 for moving back, etc. Each of such additional zones of focus 236, 238, and 239 is located in a different direction from each other with respect to the second zone 234. The athlete responds to the stimuli battery 110, for example, the illumination of lamp 118, by moving rapidly towards and through the zone corresponding to the illuminated light, for example 238. When the athlete moves through the zone, for example 238, his motion causes the digital clock to stop and display the time elapsed from his motion through the first zone.

Figures 5, 6:
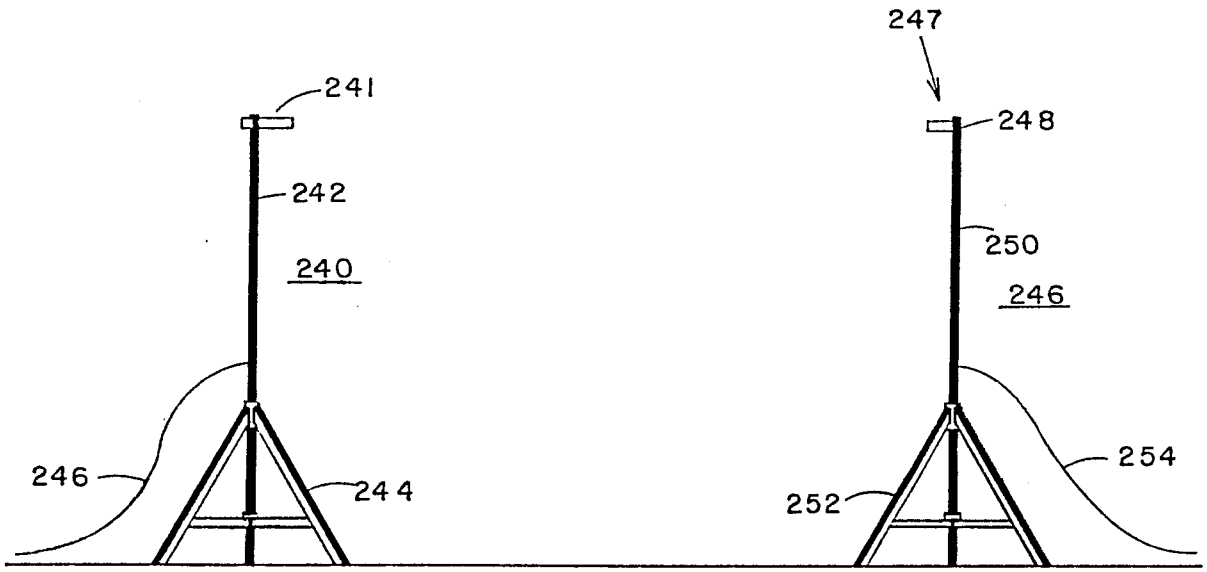
FIG. 5 is a side elevational view of a photosensor assembly.
FIG. 6 is a side elevational view of a light source for use with the photosensors of FIG. 5.
Figure 12:
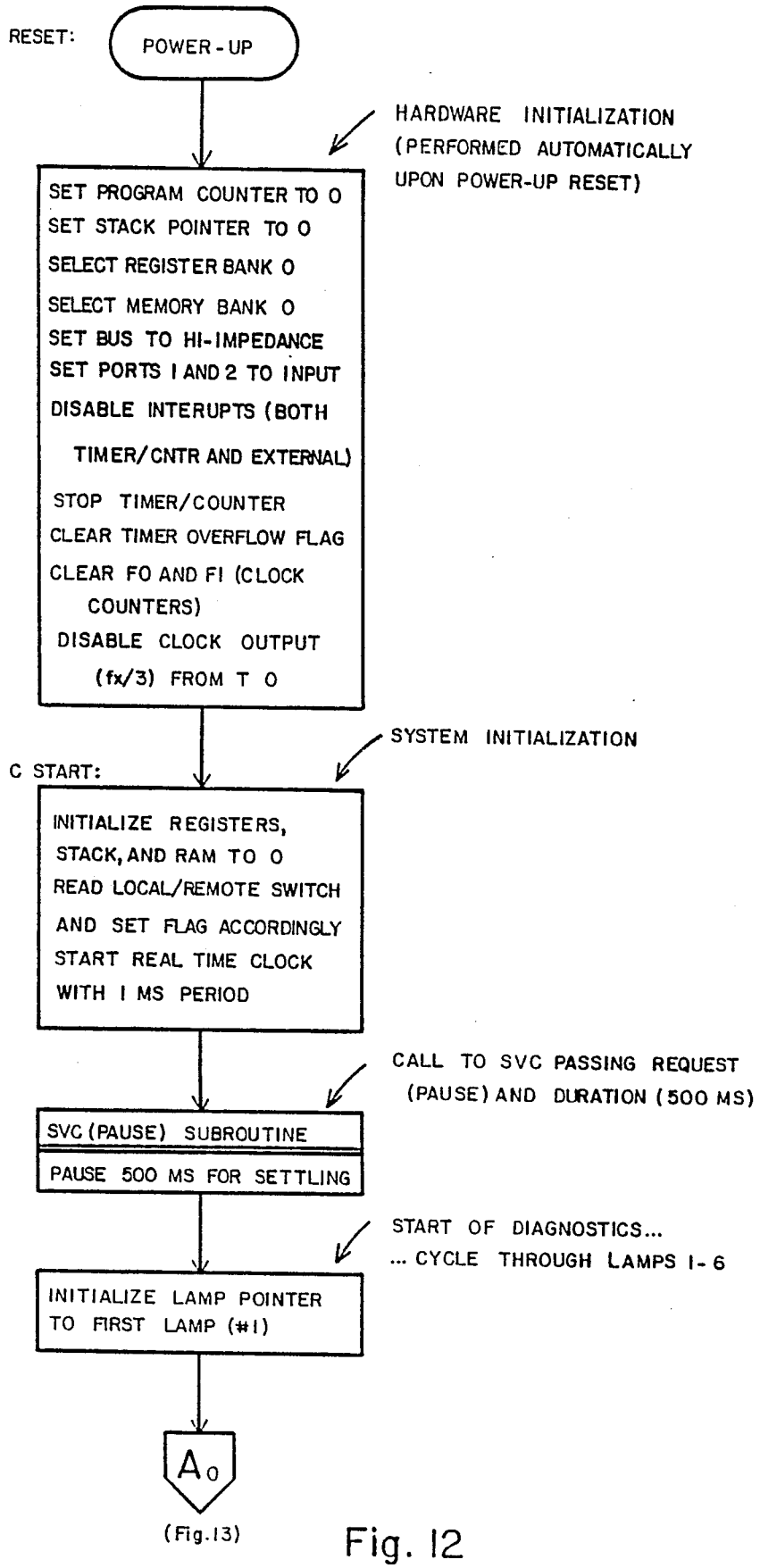
Figure 13:
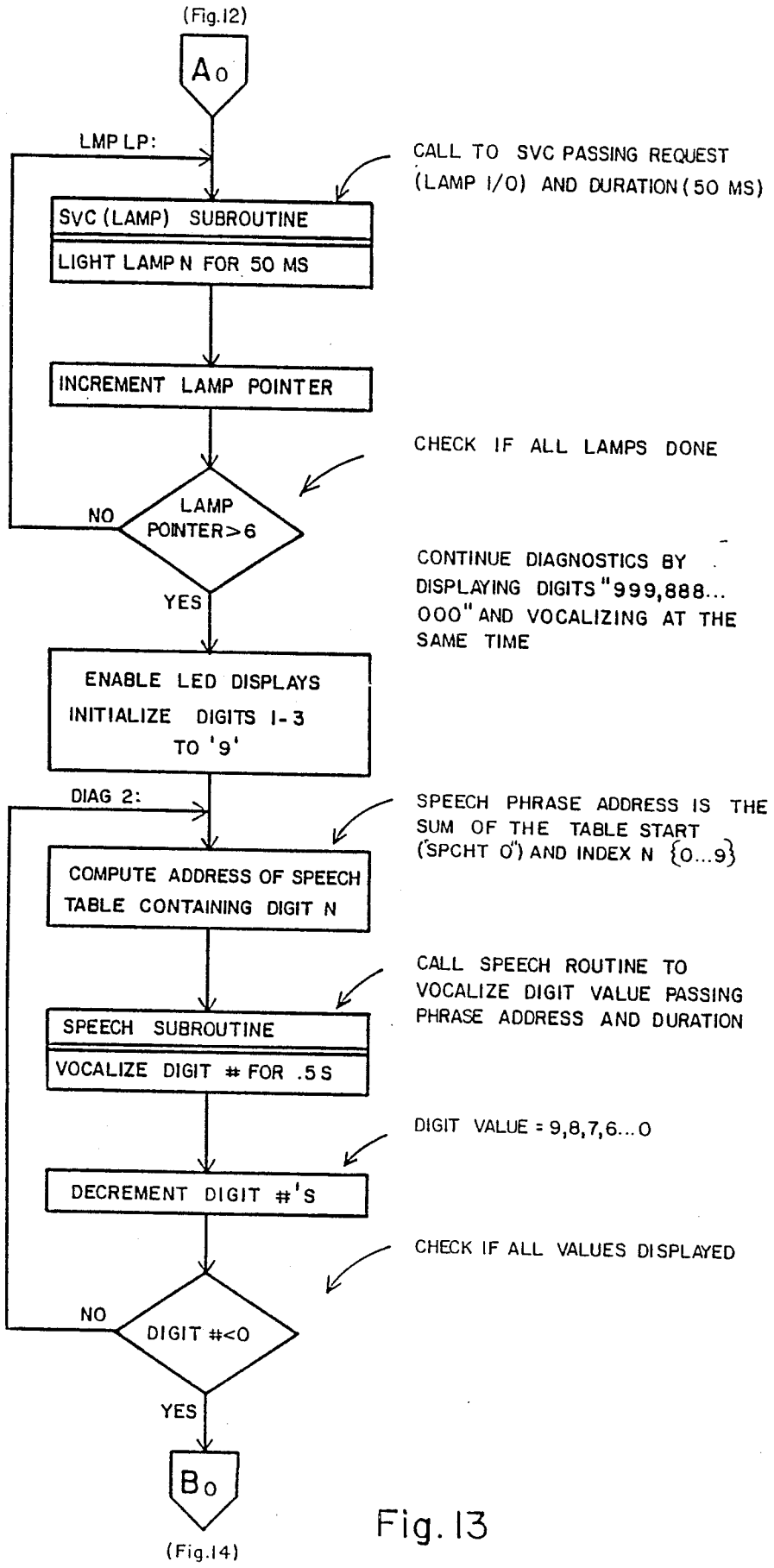

FIG. 5 is a side elevation of a photosensor assembly 240 such as is used in the drills described in FIGS. 12 and 13. It includes a photosensor 241, a support means 242, and a tripod base 244. Photosensor means 241 is a conventional photocell with appropriate means to provide a signal in response to a change in marginal light thereon. Connector 246 electrically connects photosensor means 241 to a remotely located control unit not shown.

FIG. 6 shows a light source designed to provide illumination for photosensor 241 of FIG. 5 in marginal light conditions. This light source, generally designated 247, comprises a lamp 248, a support 250, a tripod base 252, and a power cord 254 leading to a power source, not shown.

Figure 7:
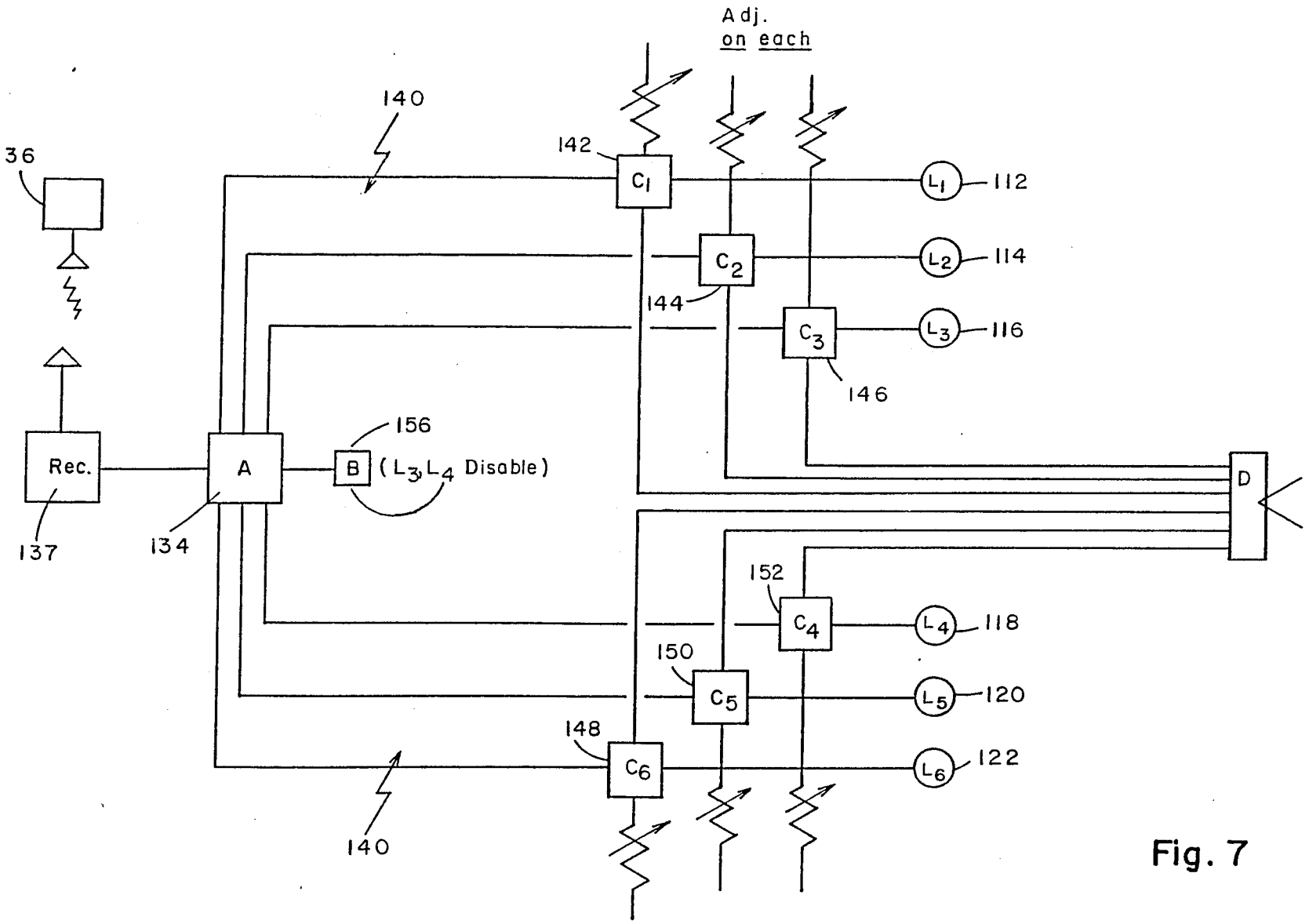
FIG. 7 is a schematic circuit diagram for a stimuli battery of the type illustrated in FIG. 3.

FIG. 7 schematically depicts an electrical control circuit for use with the stimuli battery means 110 of the type shown in FIG. 3. As shown, a signal from a trigger transmitter 136 is received by a resistor 137 and transmitted to a cyclic switch 134. The cyclic switch 134 can be in the form of a cyclic generator providing six discrete output signals at a frequency of approximately 10 KHz. The cyclic switch 134 is connected through lines 140 to individual one shot trigger circuits 142, 144, 146, 148, 150 and 152, each of which is adapted to provide an output signal of predetermined duration when triggered by a signal from the cyclic switch 134. The output signals are utilized to effect ignition of the lamps 112, 114, 116, 118, 120 and 122, respectively. Each of the one shot trigger circuits includes means, such as the illustrated adjustable resistor, to provide for user control of the time duration of the output signals from the one shot triggers, and hence the duration of lamp ignition. The termination of the output signal from the one shot trigger circuits is utilized to activate an audio signal, indicating that the period during which a predetermined movement pattern should have been completed has expired. Desirably the circuit also includes means such as logic circuit 156 to provide for user controlled disablement of particular lamps in accord with the nature of the movement patterns being utilized for training.

Figure 8:
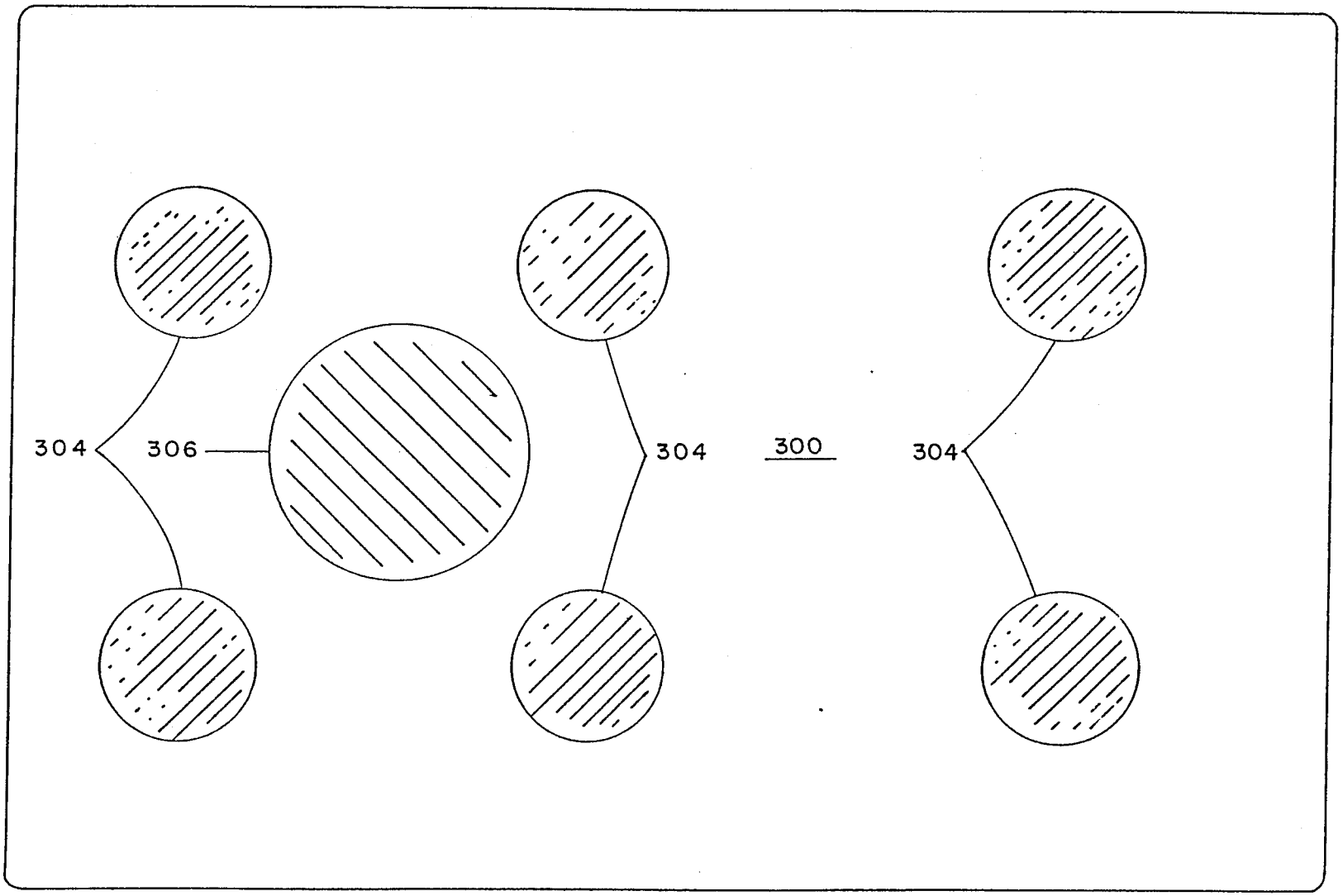
FIGS. 8 and 9 illustrate a preferred commercial embodiment of the START system designed as a portable unit the size of a small carrying case, with FIG. 8 illustrating a display panel of six high intensity lamps mounted on the inside of the top portion of the portable case, and FIG. 9 illustrating the control keypad and control display panel mounted on the inside of the bottom portion of the portable case.

A preferred commercial embodiment of the START system has been designed to have general applicability to many training programs in different sports, or in rehabilitation and general health and fitness. The preferred embodiment is designed as a portable unit which unfolds, similar to a traveling case, into an upper section 300, FIG. 8, having a top display panel, which may or may not be separable from the bottom section 302, FIG. 9, of the unit with appropriate electrical connections thereto. The unit is microprocessor controlled and programmable, as described in greater detail hereinbelow. The top display panel provides an array of six (6) high intensity lamps 304 that are strobed on/off in a pre-programmed sequence as dictated by the program number indicated by the documentation, and selected via a numeric data entry keypad, and a loudspeaker 306. The time that each lamp is illuminated, as well as the pause time between lamp strobes is also a pre-programmed parameter set for the selected program number, but these parameters can be changed and reprogrammed as described in greater detail hereinbelow.

Figure 9:
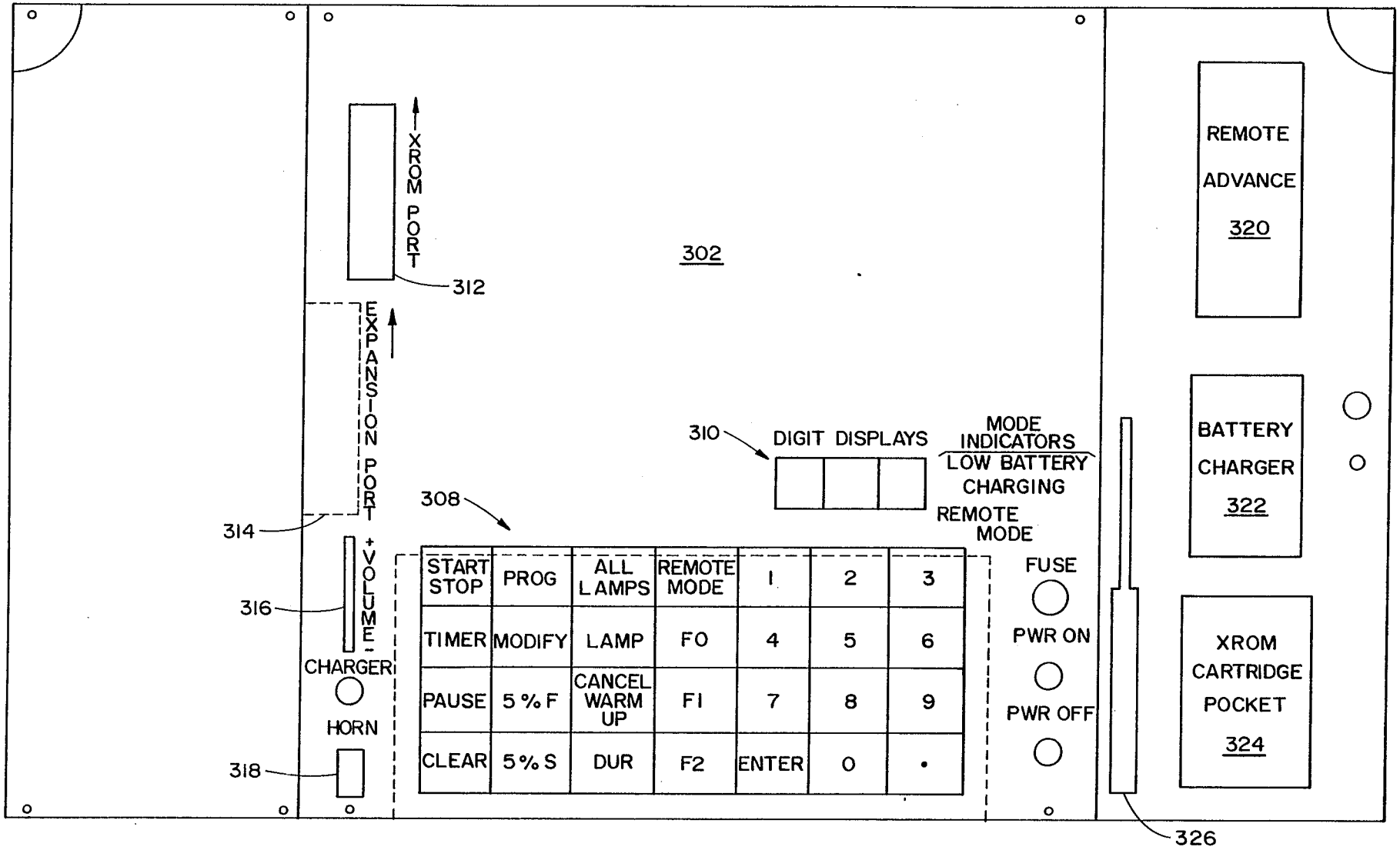

The control system, which is microprocessor controlled and programmable is mounted in the bottom section 302, FIG. 9, along with a control and programming keypad 308 of control keys, three (alternative embodiments might incorporate four or more) LED seven segment digit displays 310, an external ROM (XROM) memory cartridge port 312, a microprocessor expansion port 314, a volume control 316, an external speaker (horn) switch 318, a remote advance unit and pocket therefor 320, a battery charger unit and pocket therefor 322, an XROM cartridge storage pocket 324 wherein several XROM program cartridges can be stored, and a screwdriver 326 for assistance in servicing the unit, such as in changing fuses or bulbs.

The keypad 308 allows the user to vary the on/off times as well as the pause times in any selected program drill for any individual or multiple numbers of lamps by simply entering the desired times. This feature allows the user to custom tailor each pre-programmed training drill to the individual talents/progress of the person in training.

The design of the unit accommodates the development environment as well as the end user environment. The development environment is enhanced by allowing the system training program developers to set the various sequences of drills as well as default timing periods that are used to generate the final programs that are contained in response training drill cartridges. The user environment allows the selection of these program sequences via the keypad, and allows for selective alteration and reprogramming of the default lamp/pause timing periods by the user.

The base system is equipped with the basic response training programs in an external ROM (XROM) memory memory cartridge plugged into port 312, and is also designed with an expansion port 314 that allows the user to plug in subsequently developed program and/or feature enhancements as offered by the manufacturer. These subsequent programs and/or feature enhancements will be available in cartridge type devices that will simply plug into the expansion port 314.

Some of the programs and/or feature enhancements that can be made available through the expansion port include the following:

1. Drill sequence cartridges—drill cartridges that contain pre-programmed drill sequences that are specifically designed for a particular sport, function within a sport, weakness correction, rehabilitation exercise, etc. For example, individual cartridges may be offered that offer specific movements to improve a weakness in a particular type of commonly required movement for a sport, such as a deep baseline backhand in tennis, etc.

2. Timing measurement and plotting—a slave microprocessor controlled device may be added via the plug-in expansion port. Pressure sensitive mats, photoelectric beams, motion detection sensors, etc., measure the actual time that an athlete takes to perform the required movement. These reaction times are stored for subsequent retrieval, computer analysis, charting, etc. to enhance and/or revise a training program based upon the available performance analysis.

3. Voice enhanced coaching—voice synthesis, in addition to the basic voice synthesis that is part of the base system, can be added via the expansion port to provide prompting, tutoring, coaching, etc. to the user during the execution of the drill sequences. For example, if a common mistake during the performance of a particular movement is the incomplete turning of the hips to properly prepare for a tennis backhand, the start system could remind the user (much the same way as a personal coach would) to perform the movement using the correct technique. This feature would be implemented via the voice synthesis module, under program control.

The manufacturer developed sequences, as well as the applications software are stored in volatile memory, and allow for over-writing in the operation of the microprocessor.

All user interaction with the system is by the keypad/display module illustrated in detail in FIG. 9. The elements of the unit, which are primarily elements of this module and their major functions are as follows.

1. Numeric display 310—this is a three or four digit display that indicates the numeric entries as entered by the control keys on the keypad.

(a) The selected preprogrammed drill sequence number (00–99) that is presently being run by the unit.

(b) The drill duration time, which includes the warm-up, exercise, and cool-down times.

(c) The timing associated with the lamp strobe-on time, or the lamp strobe off (pause) time. The pause time is a global parameter that is valid for all pauses, and is not individually selectable per lamp.

2. START/STOP—This key alternately initiates and terminates the automatic pre-programmed or user modified drill sequence.

3. LAMP—This key allows the user to select the lamp or lamps whose strobe time is to be modified via the TIMER key and the numeric data entry keys, or via the 5% faster/5% slower keys, the lamp(s) selected for timing modification are indicated by the numeric display.

4. PROG (program)—This key allows the user to select the pre-programmed sequence in the XROM that is to entered via the numeric date entry keys. Each XROM cartridge contains approximately thirty separate sequence drills in memory.

5. PAUSE—This key allows the user to set the global pause time (the off time of each lamp in a sequence).

6. TIMER—This key when used in the proper sequence with the lamp select (LAMP) key allows the user to alter the on (strobe) time of the lamp(s) selected for modification, when used with the DUR key allows the selection of duration time, and when used with the PAUSE key allows selection of the global pause time. The times are entered via the numeric data entry keypad. The least significant digit provides resolution to 1/100th of a second.

8. ENTER—This key is used subsequent to any numeric entry to confirm the entry into the microprocessor.

9. CLEAR—This key is used to erase any numeric data entry (prior to entry) and/or to edit an erroneous selection.

10. Lamp Field—The lamp array provides six (6) high intensity lamps 304 that will blink as indicated by the program drill selected for training.

11. Audio Output—The volume control 316 controls an internally located speech/sound synthesis system including an amplifier, a speaker 306, a speech synthesis processor, and speech/sound PROM containing digitally encoded speech/sound data, with the circuit chips being connected together in a standard fashion as is well known and developed in the voice synthesizer arts to provide the following functions.

(a) Generation of a tone in synchronism with the off (pause) time of each sequenced lamp, thereby providing the user with instant audible feedback to determine if the particular movement was performed within the program allotted time. It has been observed that an additional benefit to the tone feedback is the stimulation of game situation reactions. The user, tending to positive feedback and reinforcement, is challenged by the system in much the same way as in an actual game situation.

(b) Speech synthesized prompting of the user to indicate, for example:

(1) System status, diagnostic failures;

(2) Operator error in selecting or entering the parameters for setting up or running a drill sequence;

(3) Next expected key entry;

(4) Notification of the start or completion time of various program segments that comprise a complete drill.

12. 5%F (5% faster)—This key causes either all of the lamps in a sequence, the selected lamp(s), or the pause timer to run at a five (5) percent faster rate. Multiple operations of this key will increment the timing reduction by 5% for each key operation.

13. 5%S (5% slower)—The same as above (#12) except that the sequence will run slower.

14. DUR (duration)—This key allows the user to specify the time duration of the particular training program drill selected by the user.

15. MOD (modify)—This key is used in conjunction with several other keys to alert the system that the user wishes to modify certain parameters of the training program.

16. F0 (BEG) (beginner)—This is a function key which initially sets the selected training program from the XROM memory to the beginner level.

17. F1 (INT) (intermediate)—This is a function key which initially sets the selected training program to the intermediate level.

18. F2 (ADV) (advanced)—This is a function key which initially sets the selected training program to the advanced level.

19. All LAMPS—This key allows the user to specify all lamps for timing modification, as opposed to individual lamps via the LAMP key.

20. CANCEL WARM UP—This key allows the user to cancel the warm up period for timing modification/-entry.

21. POWER ON—This switch applies power to the circuitry of the unit, after which the processor then maintains control over power to the system.

22. POWER OFF—This switch terminates power to the unit, and is a separate switch because of the processor control over the power.

23. REMOTE—This switch allows the user to step the selected program via the wireless remote advance coaches module or a wire connected foot switch.

The START system provides the following basic features in an external ROM (XROM) module plugged into port 312:

1. Seven random lamp sequences that can be selected as pre-programmed sequence drill numbers 01–10. The number of lamps used in each sequence will correspond to the sequence number with the exception of 07 e.g. Seq. #02 will use two lamps that will flash in a random pattern. The 07 drill number will be an alternate five lamp pattern.

2. Forty four or more preprogrammed sequences that are selected by entering the numbers via the numeric keypad. The program drill corresponds to those nomenclated on the training documentation and will run from 11 to 50.

3. A preprogrammed time period (approx. 15 secs.) that delays the start of any user selected drill until the timer has expired, thereby affording the user the opportunity to position him/herself prior to the start of the drill.

4. A preprogrammed warm-up and cool-down sequence that precedes and follows, respectively, each selected sequence. As noted above, the warm-up period is cancellable by the user. The warm-up and cool-down durations are automatically set by the system in direct relationship to the drill duration (DUR) time set for the particular selected program.

Figure 10:
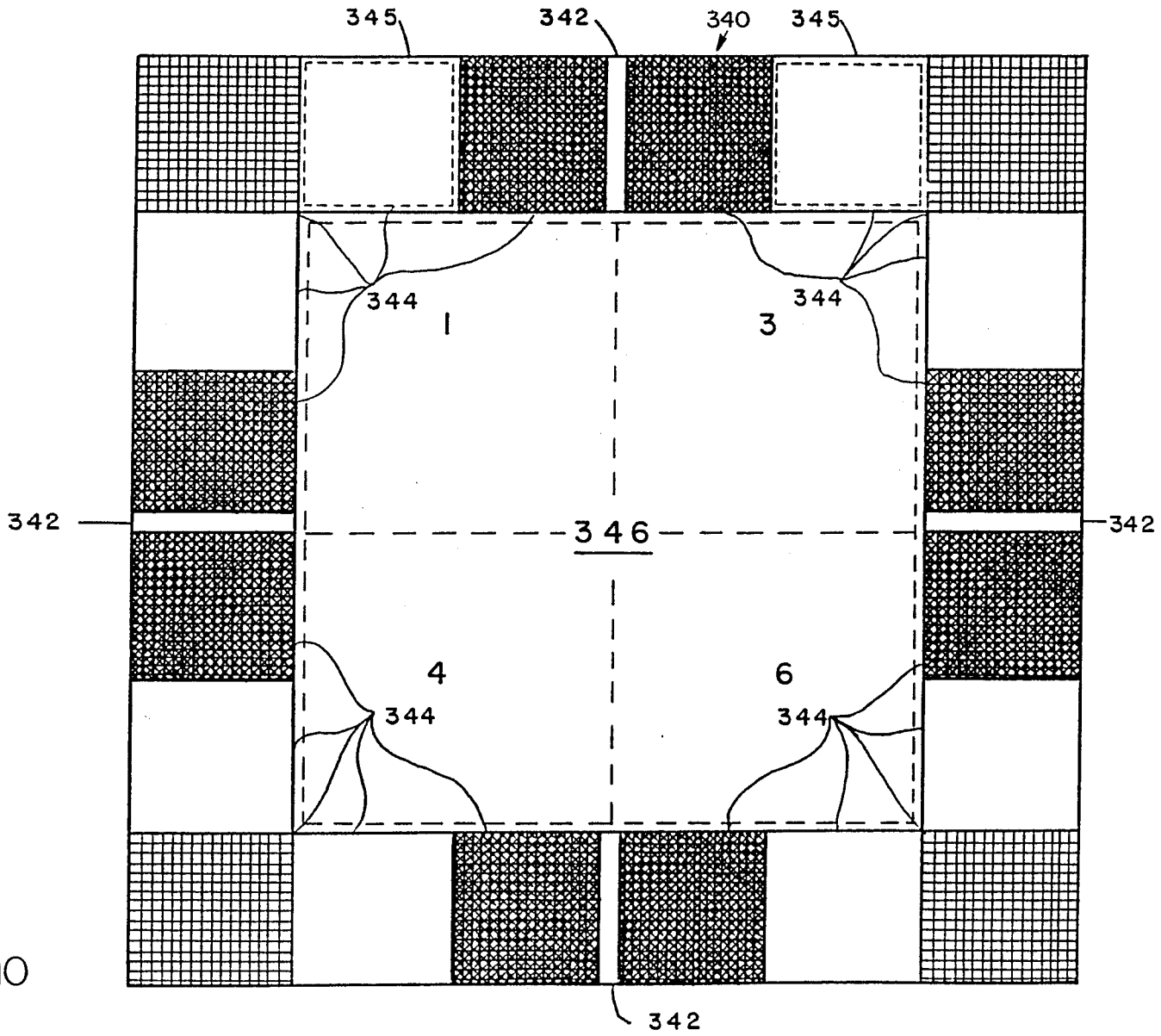
FIG. 10 is a plan view of a preferred embodiment of an exercise mat developed for use in association with the START system.

FIG. 10 is a plan view of a preferred embodiment of an exercise mat 340 developed for use in association with the START system, particularly for rehabilitation programs and in the measurement of timed responses. The training mat has the upper surface thereof marked with areas of position 342 and areas of response 344. The training mat is generally rectangular in shape, and is preferably square, and the marked areas of response 344 are arranged in a pattern around the periphery thereof, with the marked areas of position 342, being marked integrally therein. In this design, touch pads 345 can be positioned beneath different marked areas of response on the mat, or can be integrally constructed therein, such that a person orients himself with respect to a marked area of position, and then reacts to input stimulis signals to execute particular movement patterns, at the end of which the person touches a marked area of response on the training mat. Moreover, in a preferred embodiment each side of the training mat is preferably between four and ten feet in length, most preferably six feet, and includes a minimum of four, a maximum of sixteen, and in one preferred embodiment six square areas of response 344 arranged contiguously along the length thereof. A central square area 346 is thereby delineated on the central area of the training mat inside the square marked areas of response, and is adapted to receive one of several different central mat sections, with one mat section being illustrated in phantom in the drawing.

Figure 11:
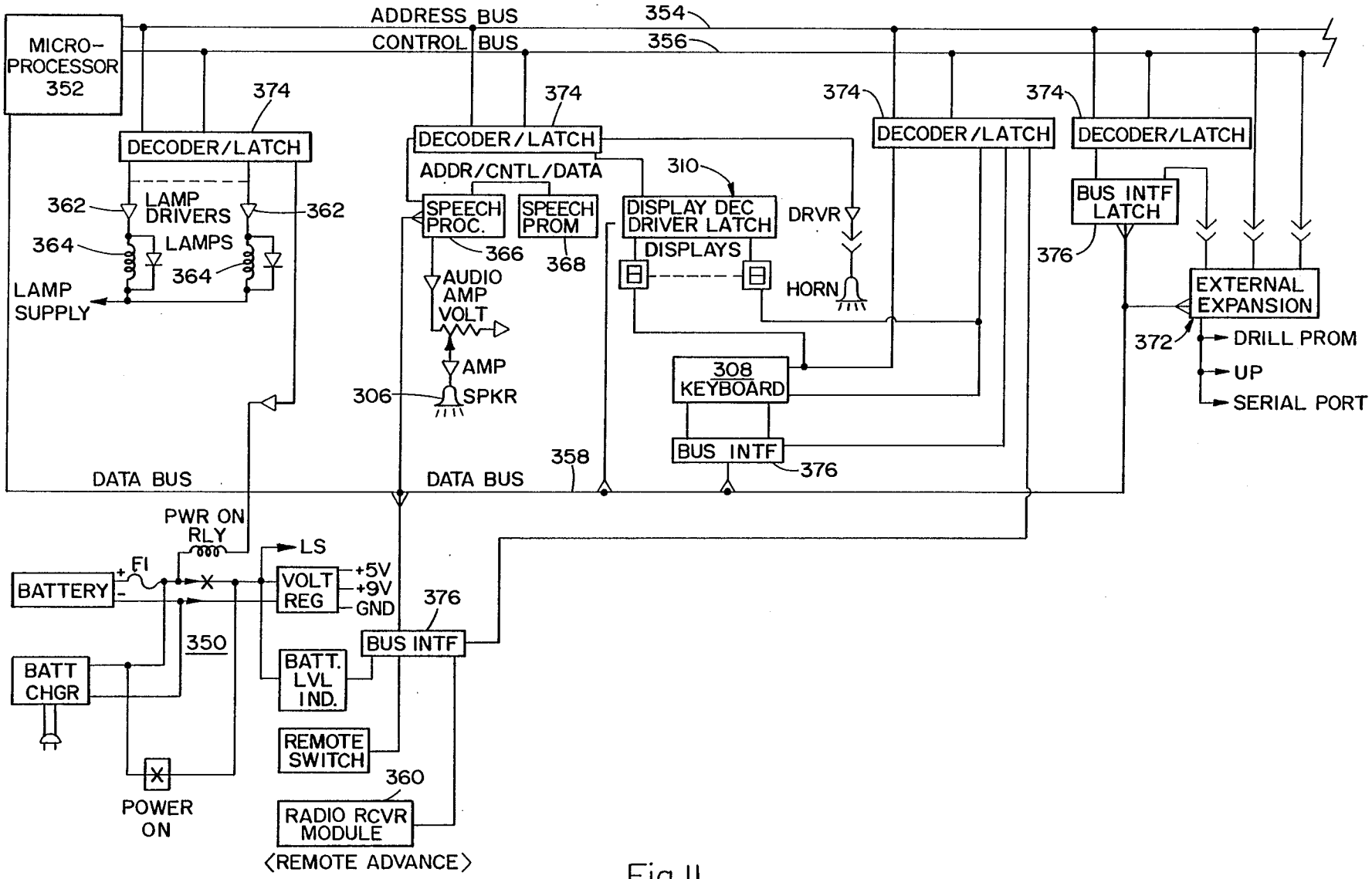
FIG. 11 is a block diagram of the major components of a preferred embodiment of a microprocessor controlled START system.

FIG. 11 is a block diagram of the major components of a preferred embodiment of a microprocessor controlled START system. Referring thereto, the START system includes the following major functional elements, a power supply 350, a microprocessor 352 with address 354, control 356, and data 358 busses, a remote advance and coaches module 360, lamp drivers 362 and lamps 364, speech synthesis chips including a processor chip 366 and a speech PROM chip 368, a keyboard 308 and LED digit displays 310, an external ROM cartridge 370 and an expansion port 372, decoder/latches 374 and bus interfaces 376.

GENERAL ARCHITECTURE

The microprocessor contains both PROM memory that provides the program execution instructions as well as certain data constants, and RAM memory that contains variables, registers, etc. that enable various processing steps and modifications.

The various system devices (lamps, speech processor, keyboard and displays, etc.) are peripherals to the microprocessor, whose selection are controlled by the microprocessor address bus and control bus. Each peripheral has its own unique address, stored as permanent data in the microprocessor memory. The control bus maintains a read (RD) function, which is used by the microprocessor to transfer data to a peripheral device. The data bus 358 is a bidirectional bus which contains, under program control, the data that is read from or written to a selected peripheral device.

To enable a particular function to be energized, the microprocessor determines the address of the device, and configures the address bus, which includes placing the proper address thereon, to perform the device selection. The data that is to be placed on the data bus is provided by the microprocessor for a write function and by a peripheral for a read function. A read or write strobe then causes the data to be accepted by the appropriate device (microprocessor or peripheral). In this manner, a number of bits equal to the data bus size (8) is transferred between the microprocessor and the peripheral.

Some devices require all eight (8) bits of data (e.g. speech synthesis phrase selection), while some require less than eight (8) bits (e.g. lamps require one bit for on/off.)

OPERATION

The microprocessor, via the stored program control logic as described hereinbelow, determines the functions to be performed, the timing requirements, the processing required, etc.

LAMP CONTROL

When the microprocessor program determines that a lamp is to be turned on for a specific period of time, it determines the address of the particular lamp required, configures the address bus 354, places the appropriate data on the data bus 358, and issues a write command. The data is then latched in the decoder latch 374, which turns on the lamp driver 362 and lamp 364. The microprocessor then performs the timing function required to accurately time the lamp on state. When the time expires, the microprocessor re-addresses the lamp, but now configures different data on the data bus, which causes the lamp driver/lamp to enter the opposite, off, state.

SPEECH SYNTHESIS CONTROL

When the microprocessor program determines that the speech processor is to output a tone, a word, or a phrase, it determines the location in memory of the word(s) required, configures the address bus 354 to select the speech processor, places the word location on the data bus 358, and then issues a write command. The speech processor 366 receives and stores the selected word(s) location, and interacts with the speech memory PROM 368 to provide an analog output that represents the speech data. The PROM 368 contains the Linear Predictive Coded (LPC) speech data as well as the frequency and the amplitude data required for each speech output. The filter and amplifier section of the circuit provides a frequency response over the audio spectrum that produces a quality voice synthesis over the loudspeaker 306 and possibly over a remote speaker (HORN).

In one designed embodiment the speech synthesis technology utilized well known designs incorporating the National Semiconductor MM54104 DIGITALKER speech synthesis processor and INTEL CORP 2764 EPROMS for speech memory storage.

KEYBOARD SCAN AND DISPLAY INTERFACE

The displays 310 are common cathode seven segment LED displays that are driven by a decoder driver. The decoder driver takes a BCD input, and provides an appropriate output configuration to translate this input to the proper segment drives to display the required character. These outputs apply a high current drive to all necessary segments, and the circuit is completed (and displays lit) by pulling the common cathode to ground.

The keyboard is an XY matrix, which allows a particular crosspoint to be made when that position on the matrix is depressed by the operator.

The microprocessor combines the energizing of the displays with the scanning of the keyboard for operator input. The displays and keyboard are constantly scanned by the microprocessor to provide a power saving multiplexing of the displays and a continuing scanning of the keyboard for operator input.

The common cathode of the display is provided with the same address as the X (row) location of the keyboard matrix. Therefore, energizing a display member also results in energizing the X (row) number of the keyboard.

For any particular scan, the microprocessor determines the address of the display to be energized (which is the same X (row) on the keyboard), and determines the data to be written on that display. The common display decoder driver latch address is determined, the address placed on the address bus 354, and the data to be displayed is placed on the data bus 358. A write (WR) strobe is then issued which causes this data to be written and stored in the latch. To energize the LED displays (complete the circuit), the microprocessor determines which digit display is to be energized, places that address on the address bus, places the data to be written on the data bus, and issues a write strobe. This causes the selected common cathode to be energized and latched, as well as the scan input to the selected X (row) of the keyboard.

To determine if a key has been depressed, the microprocessor reads the column (Y) output of the keyboard via the bus interface and places this on the address bus 354. This is decoded and the column data selected for application to the bidirectional data bus 358. The microprocessor 352 then issues a read (RD) command which causes this data to be stored in a bus memory location. Analysis of this bit pattern allows the microprocessor to determine if a keyboard crosspoint was made, corresponding to an operator selector. This scanning operation is performed at a sufficiently high rate to detect normal keystrokes as well as to provide a multiplexed output that is bright and appears nonflickering to the human eye.

EXTERNAL ROM

The external ROM (XROM) contains the preprogrammed drill sequence data used to run an operator selected drill. This design approach provides great flexibility in setting up drills while using the resources of the microprocessor controlled peripheral devices. The XROM is programmed with data, in sequence, that allows the microprocessor to perform the following tasks:

(1) select a lamp;
(2) select a speech synthesizer word/phrase;
(3) select a tone output.

The XROM also contains default timing data for the following which is used in the exercise program when the operator does not select and enter alternative times:

(1) lamp-on time; and
(2) pause time.

It can be readily seen that by properly encoding the XROM data, the microprocessor can execute numerous types of drill sequences which can combine the above mentioned parameters. It can also be observed that the use of plug-in cartridge XROMS allows a variety of sequence drills to be developed, equipped and executed with little if any programming by the user. A variety of plug-in cartridges can be developed for specific sports, weakness drills, rehabilitation programs, etc.

When the microprocessor 352 determines that the user has selected the START/END key, and is thereby requesting the initiation of a drill sequence, it obtains the address of the present step to be executed in the XROM, and places this address on the system address bus 354. The XROM is then activated, and places the selected data on the data bus 358. The microprocessor 352 then issues a read command, which causes this data to be stored in the microprocessor register for interpretation and processing. The XROM storage format are fixed, so that if a lamp-on command is read from the XROM, the microprocessor knows that the next sequential address contains the lamp-on operation time.

The microprocessor continues the execution of the XROM instructed drill sequence until the drill operation time has expired, or until the user stops the drill manually. It should be noted that each drill sequence is comprised of a limited finite number of steps (locations) in the XROM memory. The microprocessor continually cycles through the steps to perform the drill. However, to achieve a truly random nature for a drill, the microprocessor does not always start each sequence at the initial step (location), but rather starts at some randomly indexed namable location, as explained further hereinbelow with reference to FIG. 18.

The START system preferably is controlled and run by a single chip microprocessor, and in one embodiment the particular microprocessor used was the P8749H type chip from the Intel Corporation which contains an 8-bit Central Processing Unit, 2K×8 EPROM Program Memory, 128×8 RAM Data Memory, 27 I/O lines, and an 8-bit Timer/Event Counter. Details of the architecture and use of this chip are described in detail in numerous publications by the manufacturer, including a manual entitle INTEL MCS-48 FAMILY OF SINGLE CHIP MICROCOMPUTERS USER'S MANUAL.

PROGRAM OVERVIEW

Referring to FIGS. 12 through 33, the logic flow charts illustrated therein reveal the major steps of the program, which is stored in the microprocessor nonvolatile memory, for controlling the operation of the processor. A program listing of the instruction for the control of the particular instrument being described herein is attached to this patent application as an EXHIBIT and forms a part thereof.

The resident firmware that controls the operation of the unit can, for the purposes of explanation, be divided into four major categories. These are: the foreground task, the background task, the utility subroutines, and the data tables. It should be noted that although the word "task" is intermixed throughout this firmware description with the word "program", indeed no true task structure associated mechanism (i.e. task switching/scheduling) has been implemented.

The foreground task has as its responsibilities, hardware and software initialization, start-up device diagnostics, user interaction (including input error checking and feedback), drill selection and modification, drill execution, and overall device state control (e.g. running/paused/idle). This portion of the program performs its duties by both interacting with the free-running background task to interface with the hardware environment, and tracks all time dependent functions as well as calling upon the various subroutines that exist to carry out their predetermined assignments.

The functions of these subroutines include: reseeding of the pseude-random drill index, fetching and executing selected drill data from the external ROM (XROM), general purpose multiplication by ten, binary to decimal conversion, speech processor invocation, computation of "warm-up" and "cool-down" times, user preparation prompting, crosspage jump execution, service SVC request flag manipulation (both setting and checking for completion), and local/remote mode determination. As these routines are called solely by the foreground program, they can be thought of as an extension thereof which have been demarcated for the purpose of saving Program Memory as well as to allow for their independent development/testing.

The background task, which is functionally described in greater detail hereinbelow, has as its responsibilities, event timer control, I/O execution/timing control, LED display refreshing, and keyboard scanning and debouncing.

The data tables, which are located on a special "page" of Program Memory to maximize look-up speed and efficiency, supply synthesized speech address and script information, keyboard matrix translation information, present-to-next state transition data, and warm-up/cool-down duration ratios.

OVERALL OPERATION

In operation, the foreground program is activated upon power-up, at which time it initializes (FIGS. 12 through 16) both hardware and software environments to a known condition. A diagnostic test of the device (LED display, XROM interface, clock circuitry, speech synthesizer and associated filters/amplifier/speaker) is then performed. Any detected failure causes the user to be notified and the device to be powered-off barring further unpredictable operation. If all is operating properly, the program enters a loop awaiting either the expiration of a watchdog timer that serves to preserve battery power if the device is left unattended, or the inputting of drill selection/modification commands by the user via the front panel mounted keyboard. Once a selected drill is running, the foreground task retrieves the drill steps from the XROM, formulates the necessary SVC requests, and passes them to the background task for execution.

At a frequency of 1 kHz, an interrupt is generated by the timer/counter circuitry causing suspension of the foreground program and activation of the background program to check for outstanding or in progress I/O requests, event timer expiration, keyboard entry, and updating of the LED displays. Coordination of the two programs is achieved through the use of the service (SVC) request flags and shared buffers.

Figure 17:
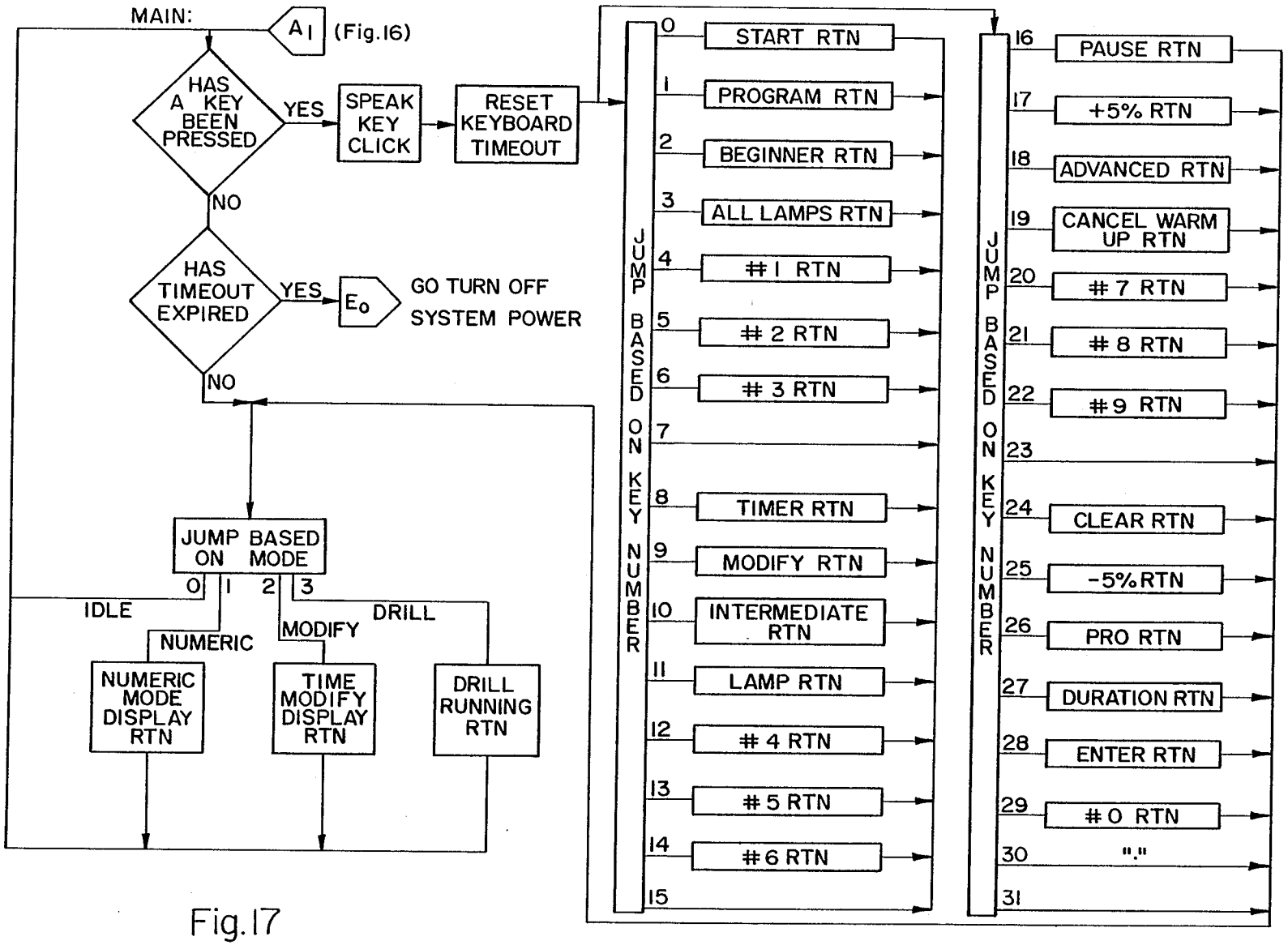

The detection of any event (an expired timer, keystroke, etc.) by the background task results in the examination of the current machine state by the foreground program and the subsequent table-driven change to the next appropriate state. Referring to FIG. 17, the four possible machine states are 0 IDLE, 1 ENTRY, 2 MODIFY, and 3 DRILL, which together with the three drill state definition of WARM-UP, NORMAL, and COOL-DOWN and the five entry mode classifications of PROGRAM, MODIFY, DURATION, LAMP and TIMER serve to keep the foreground program informed at all times of the ongoing activity as well as the correct next-state progression.

This entire process is repeated for each step of the active drill. In addition, the EXECUTE subroutine will not, if Remote Operation has been selected, return to the caller until detection of a Remote Advance signal from the wireless transmitter/receiver pair.

Modification of the drill duration, lamp (either individually or all) on-time duration or inter-lamp pause duration on either an absolute (as entered via the numeric keypad) or percentage (±5%) basis is handled by the foreground task by the manipulation of RAM-based timer registers.

INTERRUPT CLOCK

Figure 18:
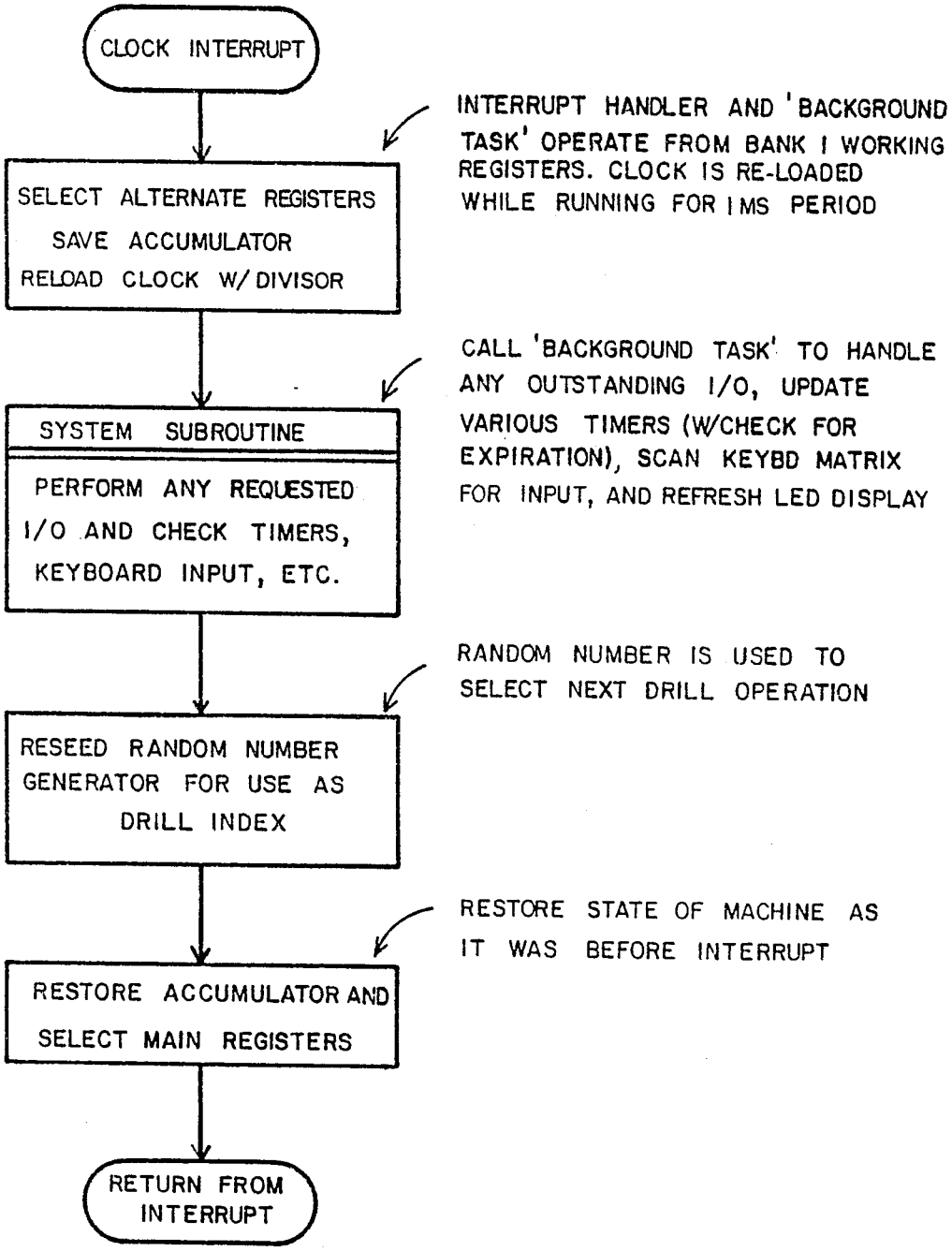

Referring to FIG. 18, the interrupt clock is managed by two routines: the clock initialization and the interrupt handler. The initialization code sets the clock interrupt interval and starts the clock. This function is performed only upon power-up/restart. The clock interrupt routine is called each time an interrupt is generated by the real-time clock. The interrupt handler immediately (after context switching from foreground background) reinitializes the clock to allow for the generation of the next clock pulse. The interrupt handler then passes control to the background program via a call to the SYSTEM subroutine.

BACKGROUND TASK-EVENT TIMING

Figure 19:
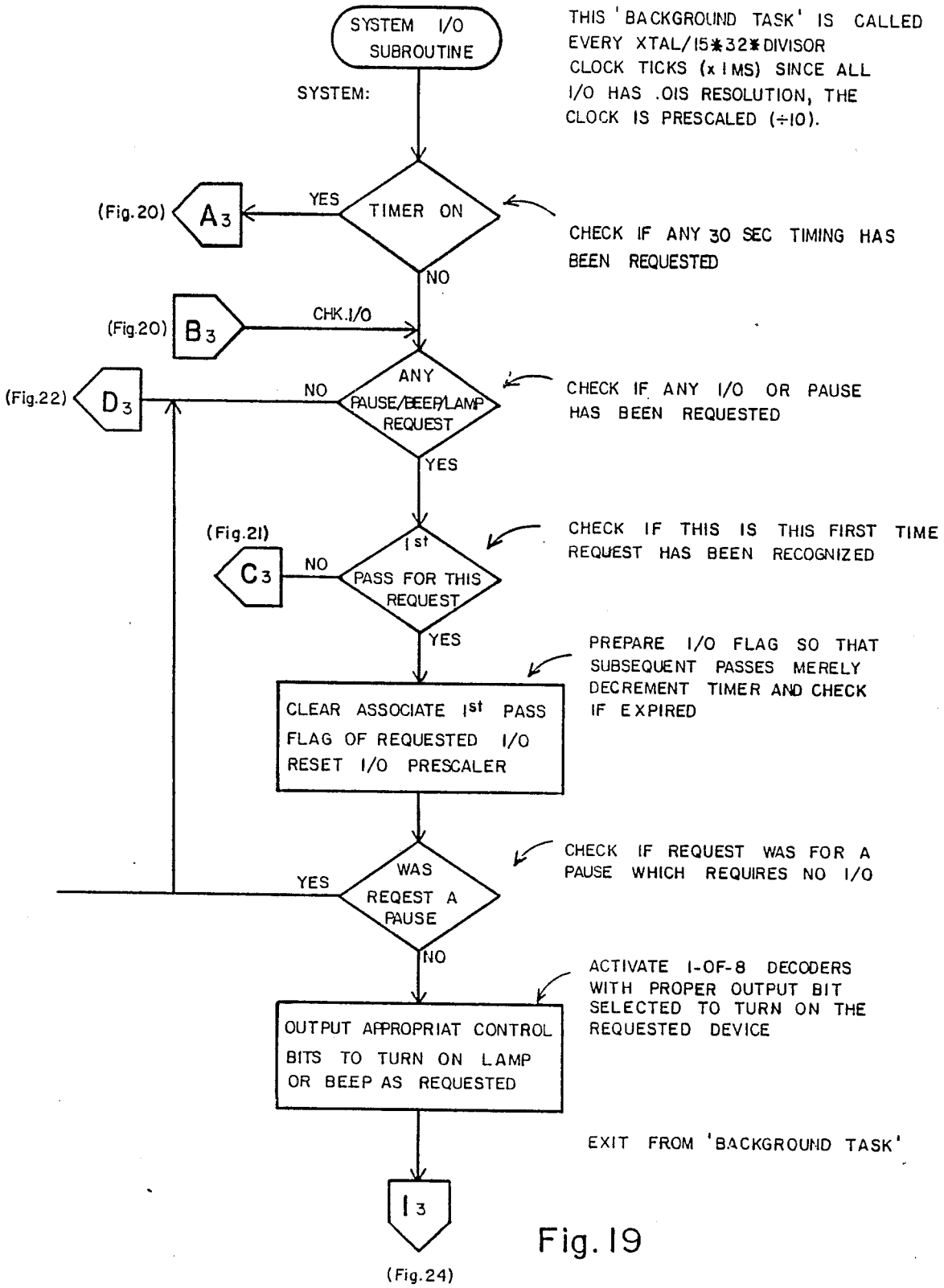
Figure 20:
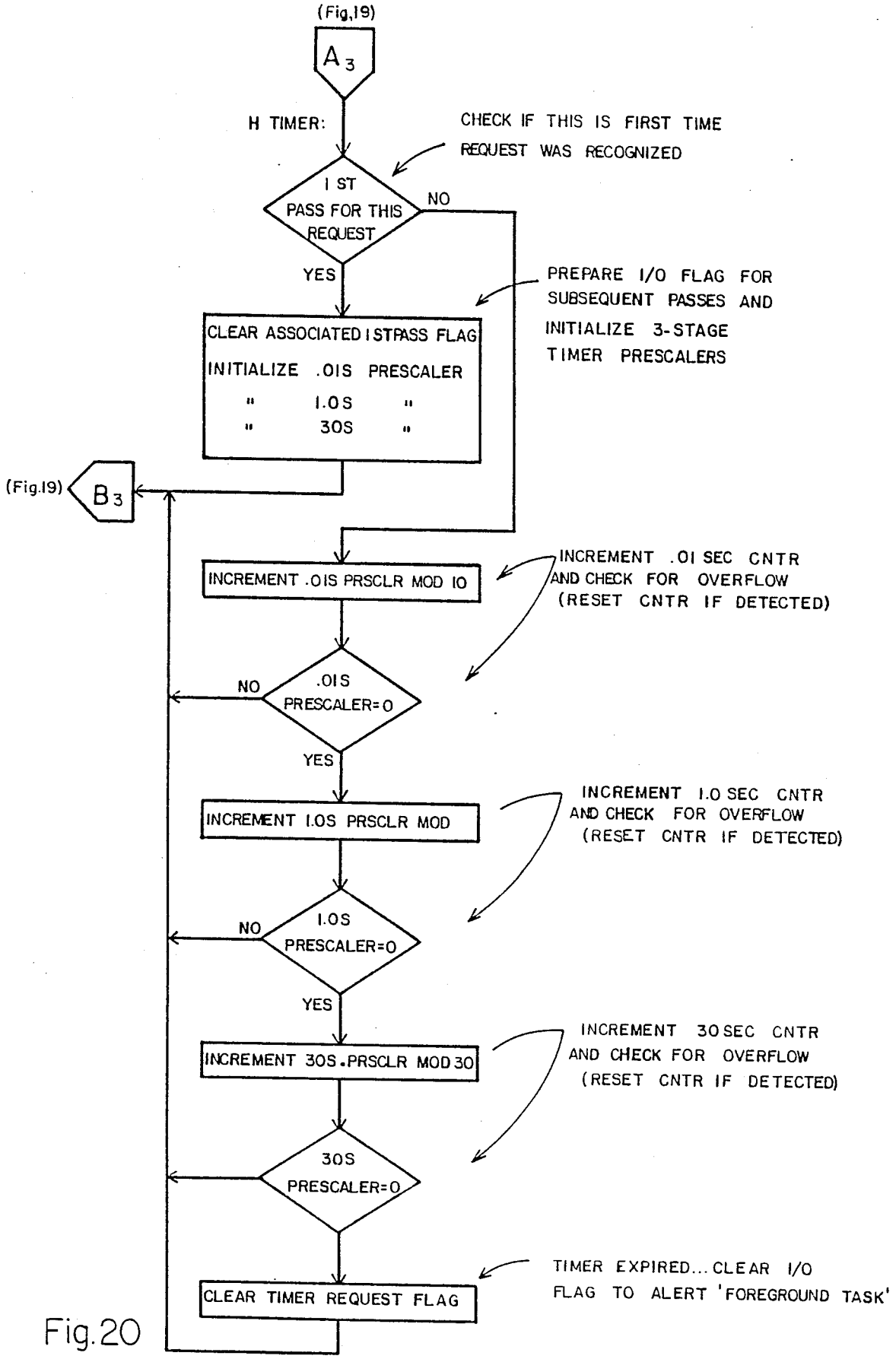

Referring to FIGS. 19 and 20, once activated by the interrupt handler, the background program starts its time management duties by checking the SVC control word for an outstanding 30 second multiple timing request (e.g. drill warm-up duration timer). If found, an additional check is made to determine if this is an initial or a subsequent request. In the case of the former, the associated first pass flag is cleared in the SVC control word, and the 0.01, 1.0, and 30 second cascaded timers are initialized. In the case of the latter, the 0.01, 1.0, and 30 second prescalers are updated (in modulo-N manner) and a check is made for overall timer expiration. If detected, the associated request flag is cleared in the SVC control word, signalling to the foreground program that the event timer has expired and appropriated action should be taken.

BACKGROUND TASK-I/O CONTROL

Figure 21:
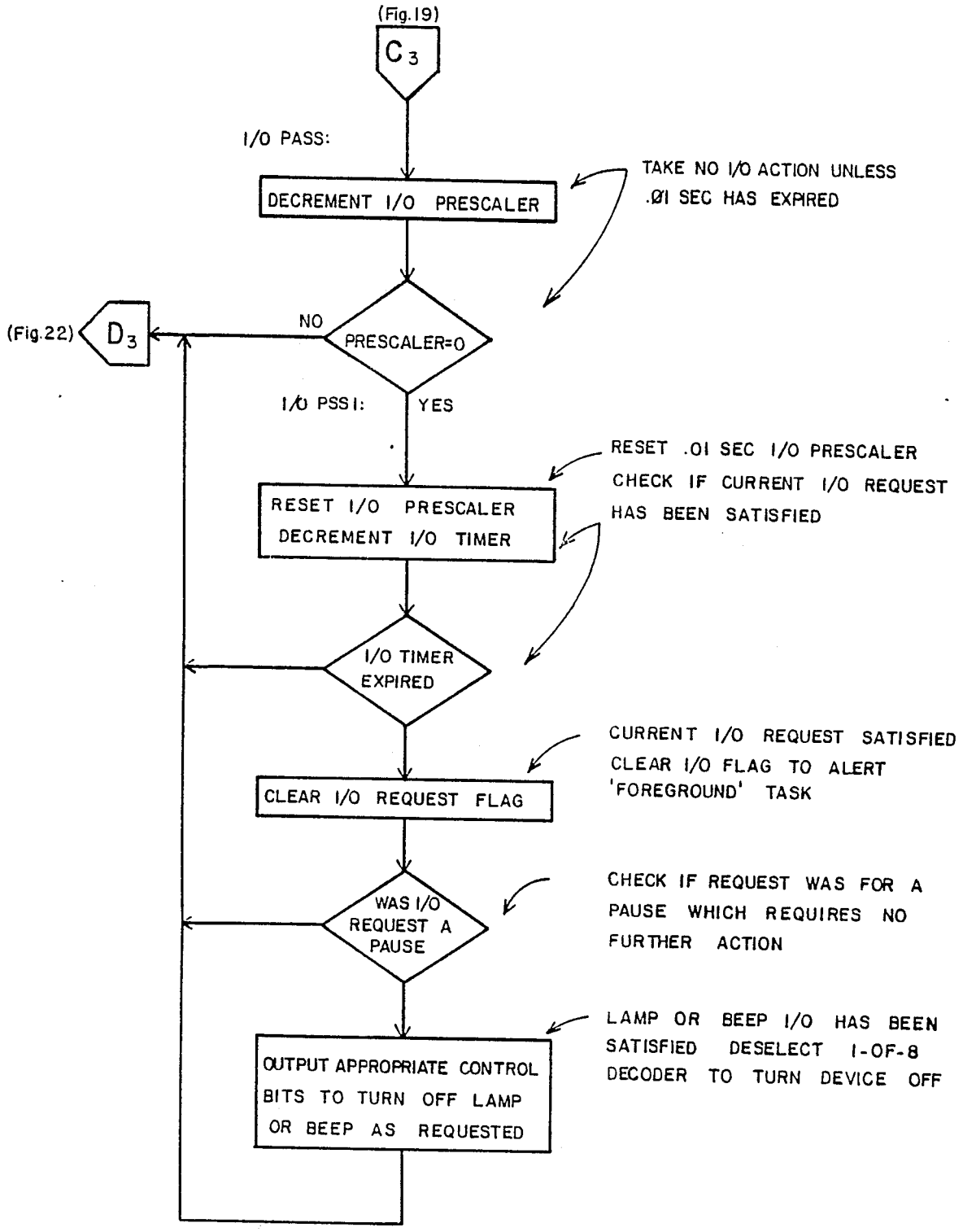

Referring to FIGS. 19 and 21, the background program then assess what (if any) I/O control is required by checking the SVC control word for an outstanding pause, beep, or lamp request. If one (they are mutually exclusive) is found, an additional check is made to determine if this is an initial or a subsequent request. In the case of the former, the associated first pass flag is cleared in the SVC control word and the 0.01 second I/O prescaler is initialized. A further test is made to determine if the request was for a pause which, although treated in a identical manner up to this point as a beep or lamp request, requires no actual hardware manipulation and would free the background task to perform its display and keyboard scanning functions. A beep or lamp request would instead cause the background task to interface to the appropriate decoders to turn the requested device on, skipping the display/keyboard scanning function in this pass. In the case of the latter (subsequent request), the 0.01 second I/O prescaler is updated and checked for expiration. If not yet expired, no further I/O control is performed, and the background program continues with its display/keyboard duties. Upon expiration, the associated request flag is cleared in the SVC control word as a signal to the foreground program that the I/O is completed. In addition, if the request was for a beep or lamp, the background program simultaneously interfaces to the appropriate decoders to turn off the requested device. In any case (pause/beep/lamp), the background task advances to the display/keyboard scanning function.

BACKGROUND TASK-DISPLAY CONTROL

Figure 22:
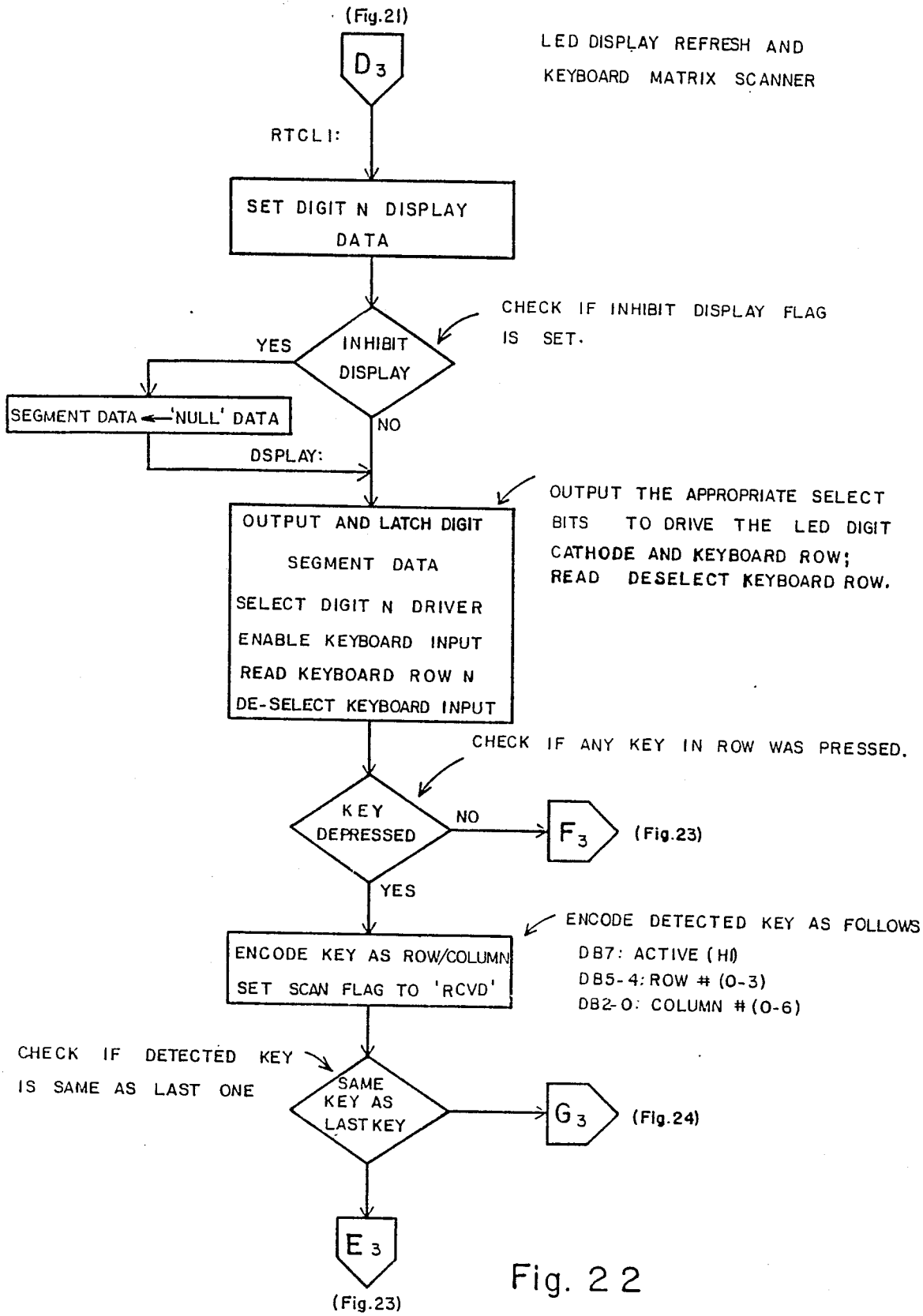

Referring to FIG. 22, the algorithm for driving the display uses a block of internal RAM as display registers, with one byte corresponding to each character of the display. The rapid modifications to the display are made under the control of the microprocessor. At each periodic interval the CPU quickly turns off the display segment driver, disables the character currently being displayed, and enables the next character. This sequence is performed fast enough to ensure that the display characters seem to be on constantly, with no appearance of flashing or flickering. A global hardware flag is employed as a "blank all digits" controller, while individual digits may be blanked by the writing of a special control code into the corresponding display register.

BACKGROUND TASK-KEYBOARD SCANNING

Referring to FIG. 22, as each character of the display is turned on, the same signal is used to enable one row of the keyboard matrix. Any keys in that row which are being pressed at the time will pass the signal on to one of several return lines, one corresponding to each column of the matrix. By reading the state of these control lines and knowing which row is enabled, it determines which (if any) keys are down. The scanning algorithm employed requires a key be down for some number of complete display scans to be acknowledged. Since the device has been designed for "one finger" operation, two-key rollever/N-key lockout has been implemented. When a debounced key has been detected, its encoded position in the matrix is placed into RAM location "KEYIN". Thereafter the foreground program need only read this shared location repeatedly to determine when a key has been pressed. The foreground program then frees the buffer by writing therein a special release code.

MORE DETAILED EXPLANATION OF FIGS. 12–35

Referring to FIG. 12, the hardware initialization as set forth in the top block is performed automatically upon power-up reset. The system components in the second block are then initialized. The third block represents a pause of 500 milliseconds. The last block on FIG. 12 and the top of FIG. 13 represents a routine to light each of the six lamps in turn for 50 milliseconds. After that, the LED displays are initialized to display a 9, and the speech synthesizer simultaneously voices "nine" for 0.5 seconds. The lower section of FIG. 13 represents a routine wherein that same function is repeated for 8, 7, etc. until the digit 0 is reached.

Figure 14:
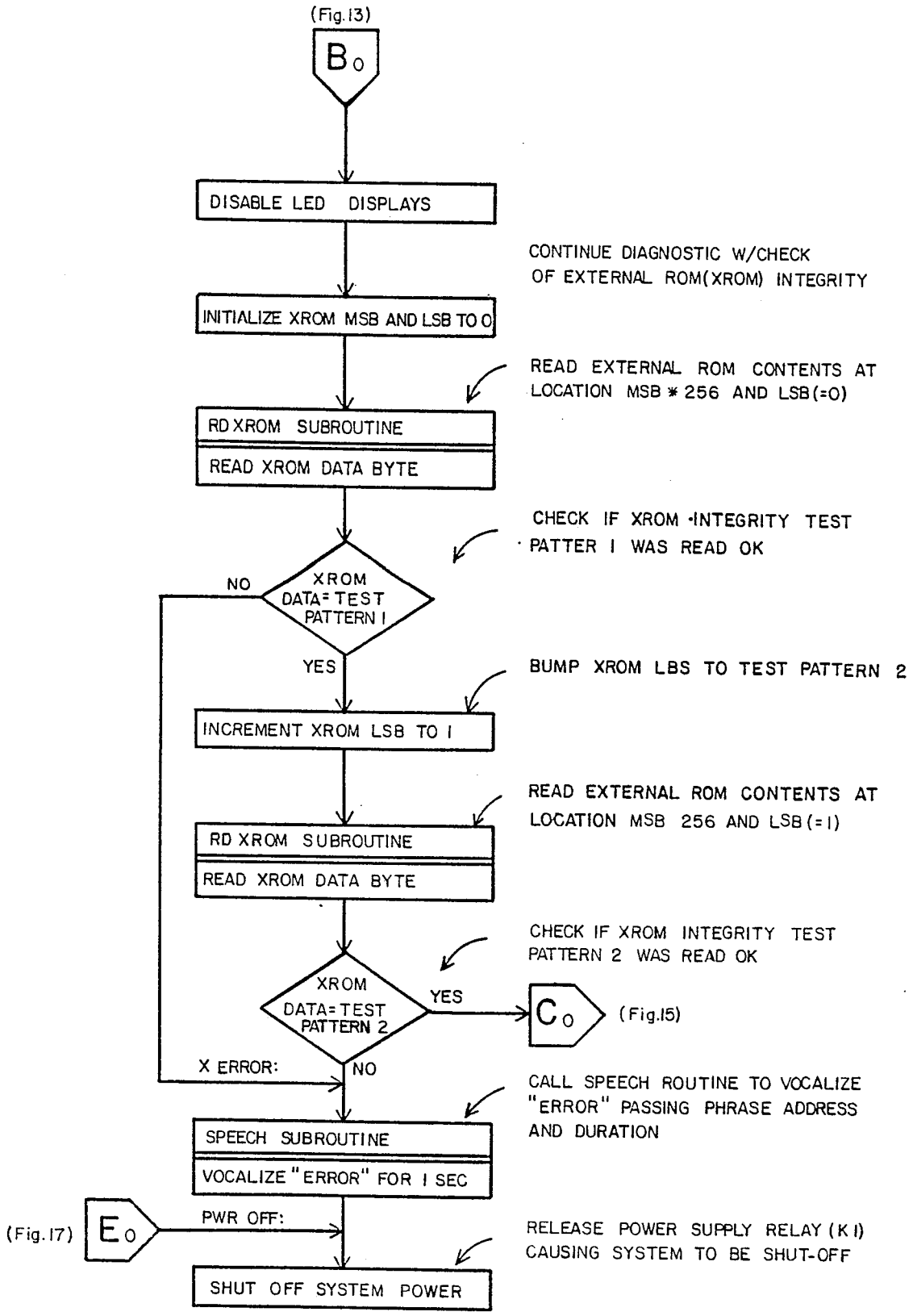

Referring to FIG. 14, the LED displays are then disabled, and the byte at a given set location in the XROM cartridge is read out, which byte should correspond to a test byte pattern. If so, the location in XROM is incremented for a second test byte pattern. If both test patterns match, the logic flow continues to FIG. 15. If either of the test patterns do not match, a speech subroutine is called to vocalize "error", and the system power is shut off.

Figure 15:
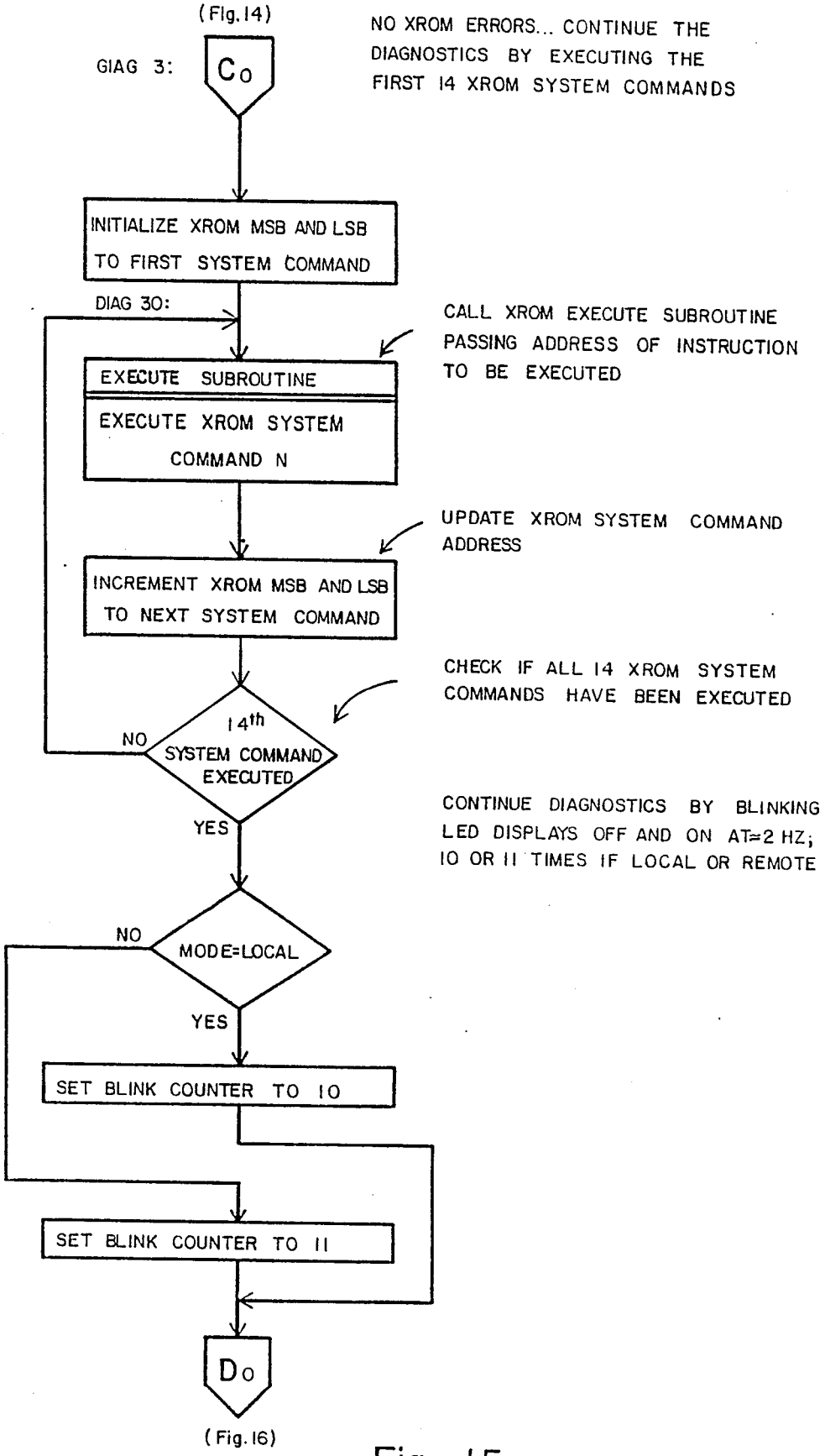

Referring to FIG. 15, the top blocks therein represent a routine for proceeding through fourteen sequential XROM test instructions, after which the remote input is checked to determine if remote control is indicated. If local control is indicated by the switch on the control panel, the blink counter is set to 10, and if remote control is indicated, the blink counter is set to 11.

Figure 16:
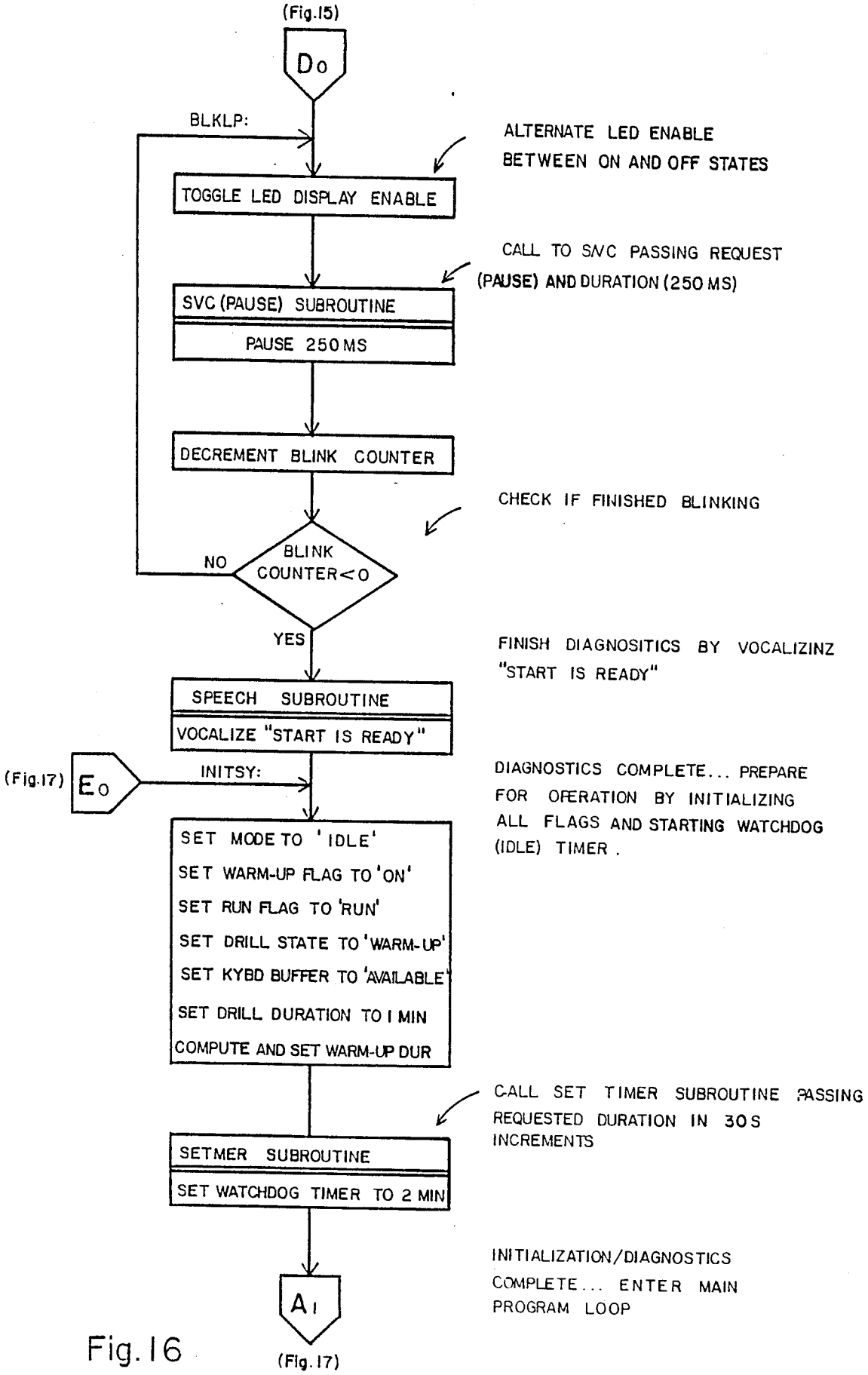

The routine at the top of FIG. 16 causes a blinking of the LED displays for 250 milliseconds and the successive decrementing of the blink counter to 0. At that time, the speech synthesizer is invoked to voice "START is ready", and the diagnostics are now completed. The system is then prepared for operation by initializing all flags and starting the idle counter, which is a power-saving counter to shut the system off after 10 minutes if no input commands, such as pressing the START key, are received.

The system then enters the main program loop of FIG. 17, which allows an operator to select a particular drill and set up all selected parameters of the drill, after which the operator presses the START key. The top of FIG. 17 represents the speech synthesizer being invoked to enable a key "click" to be heard after each entry, and the idle counter is reset after each entry.

Figure 27:
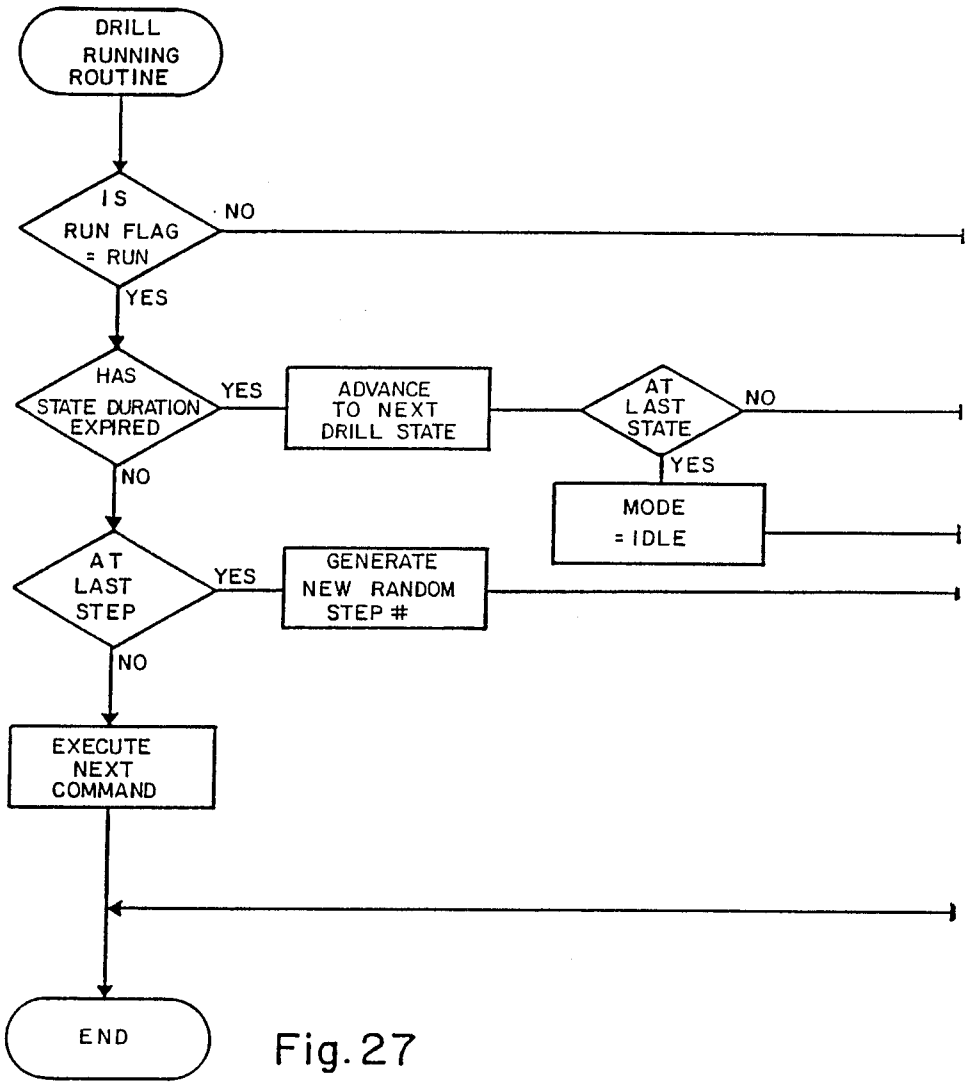
Figure 26:
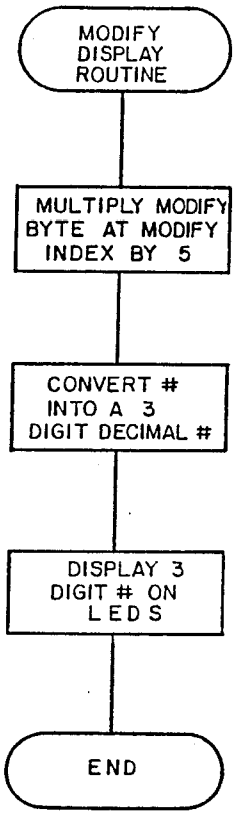
Figure 25:
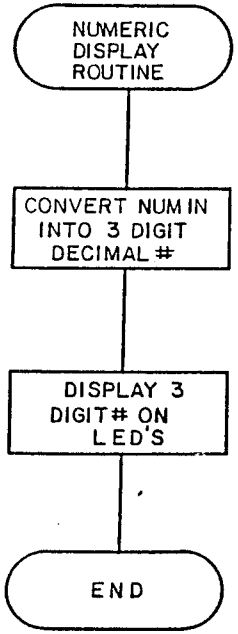
Figure 28:
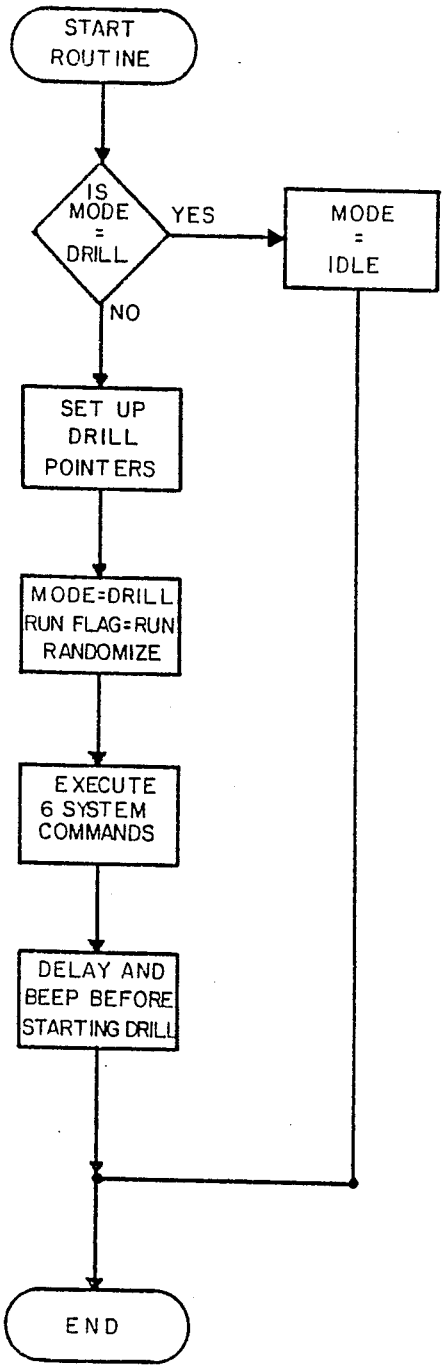
Figure 30:
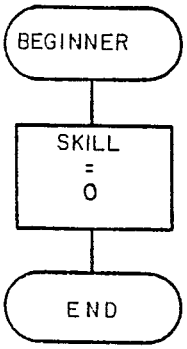

The right portion of FIG. 17 represents 32 different routines corresponding to the possible keystrokes, the more complicated of which routines are illustrated in FIGS. 28 through 35. The middle left of FIG. 17 represents four state routines of the system, the 1, 2 and 3 states of which are illustrated in FIGS. 25, 26 and 27. The 0 state routine is an idle state, during which the idle counter is running. The 1 state routine, FIG. 25, is a numeric state routine in which a selected numeric mode is displayed in accordance with each key entry. The 2 state routine, FIG. 26, is a time modify display routine, and the 3 state routine FIG. 27, is a drill running routine. After completing one of the four state routines, the routine of FIG. 17 is repeated.

FIG. 18 is a high level overview of the background tacks, and represents the background clock interrupt routine which serves as the entry and exit mechanism to the background tasks. Upon receipt of the real-time clock interrupt (every millisecond) the present state of the system is stored in memory for later restoration by selecting alternating sets of registers. The clock is reloaded with the necessary divisor for subsequent interrupt generation, and a call is made to the "system" subroutine to perform all timekeeping functions, keyboard scanning, LED refreshing and any outstanding I/O.

Upon return from the "system" subroutine, the clock interrupt routine re-seeds the psudo-random number generator for use as the starting drill index into the XROM, effectively giving the drill program its random nature.

The state of the system is then restored to the same state as prior to executing the clock interrupt routine, and the program then returns from the background tasks of FIG. 18, to the main loop of FIG. 17.

FIGS. 19 through 24 represent background tasks which are performed approximately once every millisecond, and the logic flow diagrams of FIGS. 19 through 24 are all interconnected as shown throughout those Figures, such that the actual operation of the logic flow is dependent entirely on the state of the overall system.

Referring to FIG. 19, if a timer is on, the system proceeds to the timing routine of FIG. 20, and then returns back to FIG. 19 on input B3 to the same logic point in FIG. 19 as when no timer is on. The routine then checks if any pause, beep or lamp has been requested, and if not, proceeds to the keyboard scanning function and LED display refresh routine of FIG. 22. If a request was present, a check is made as to whether this a first request, and if not, it proceeds to the Input/Output (I/O) pass routine of FIG. 21. If the request is a first request, a first pass flag of the requested I/O is cleared so that subsequent passes merely decrement the associated timer until time expires. If the I/O request was for a pause, the routine proceeds to the keyboard scanning and LED refresh routine of FIG. 22, and if not, the data bus is configured to activate the lamp or beep as requested, and the routine then exits from the background task routine.

FIG. 20 represents the logic flow diagram for a 0.01 second counter, a 1.0 second counter, and a 30 second counter. The microprocessor described herein is an eight bit machine, and accordingly contiguous bytes are utilized to obtain the necessary timing resolution. In this routine, if this is a first pass for the timing request, the first pass flag is cleared and the 0.01 sec., 1.0 sec., and 30 sec. prescalers are initialized. The prescalers are then incremented as shown in this routine, which is fairly standard in the art.

FIG. 21 represents an I/O pass routine for generally checking the state of the light times, and more particularly on resetting the I/O prescalers, clearing the I/O request flags, and configuring the data bus to turn off a lamp or beep as requested, and also is a straight forward routine.

FIG. 22 represents the LED display refresh and keyboard matrix scanner which are interdependent as described hereinabove. In this routine, the n digit display data is initially obtained, and the inhibit display flag is then checked. If it is set (i.e. inhibit requested), the digit segment display data is replaced by a special "null data" code which forces the LED decoder driver to turn all segments off on the selected digit. If not set, the address bus, control bus and data bus are configured to drive the LED digit cathode and keyboard row, and then read and interpret the output from that row of the keyboard. If a key was depressed, the program proceeds to the key detect and debouncing routine of FIGS. 23 and 24, which again is a fairly standard routine in the art. If a key was depressed, the key row and column are encoded and a scan flag is set as an indicator that the debounce counter should be reinitialized upon exit from the background task.

Figure 23:
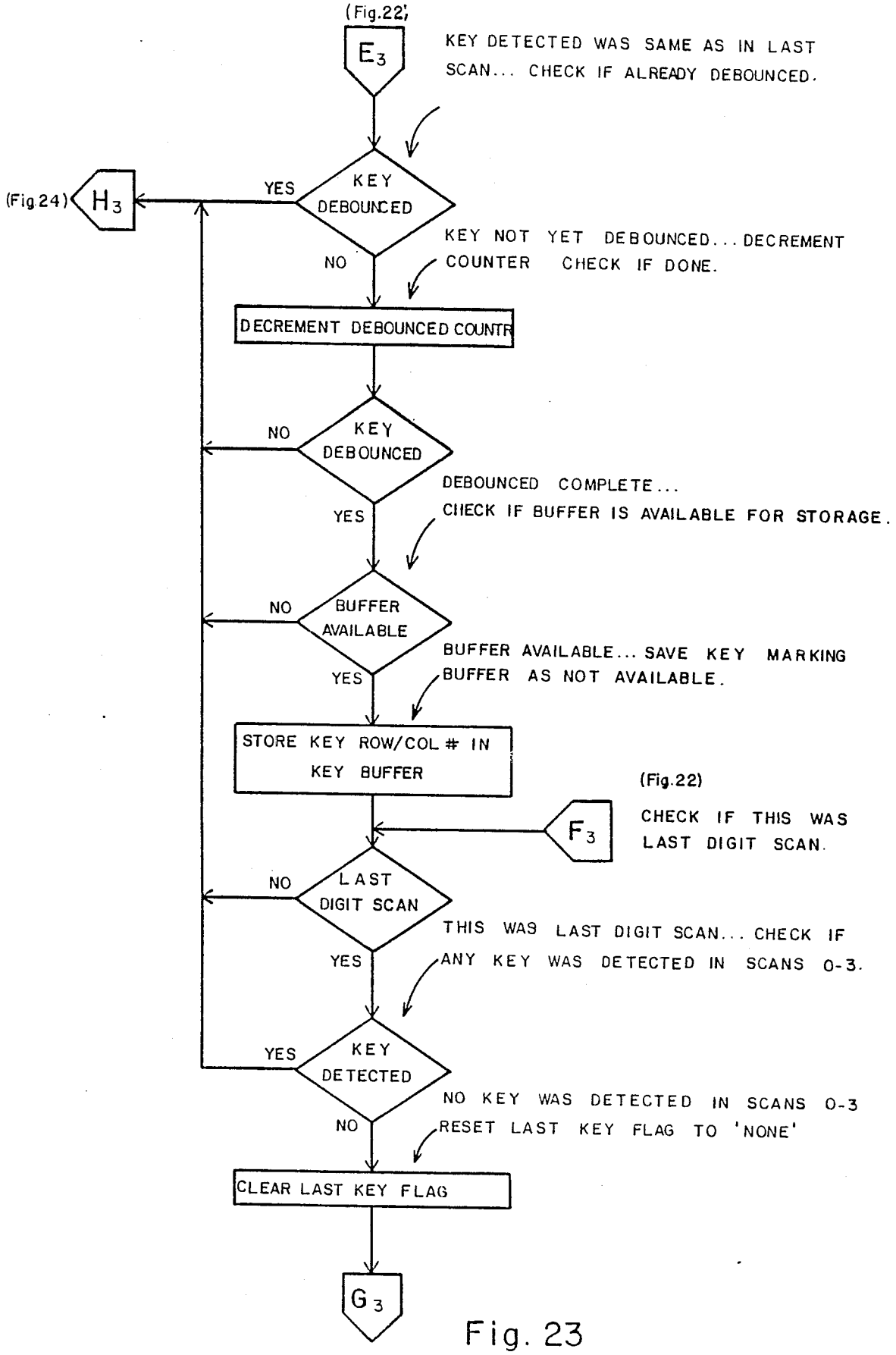
Figure 24:
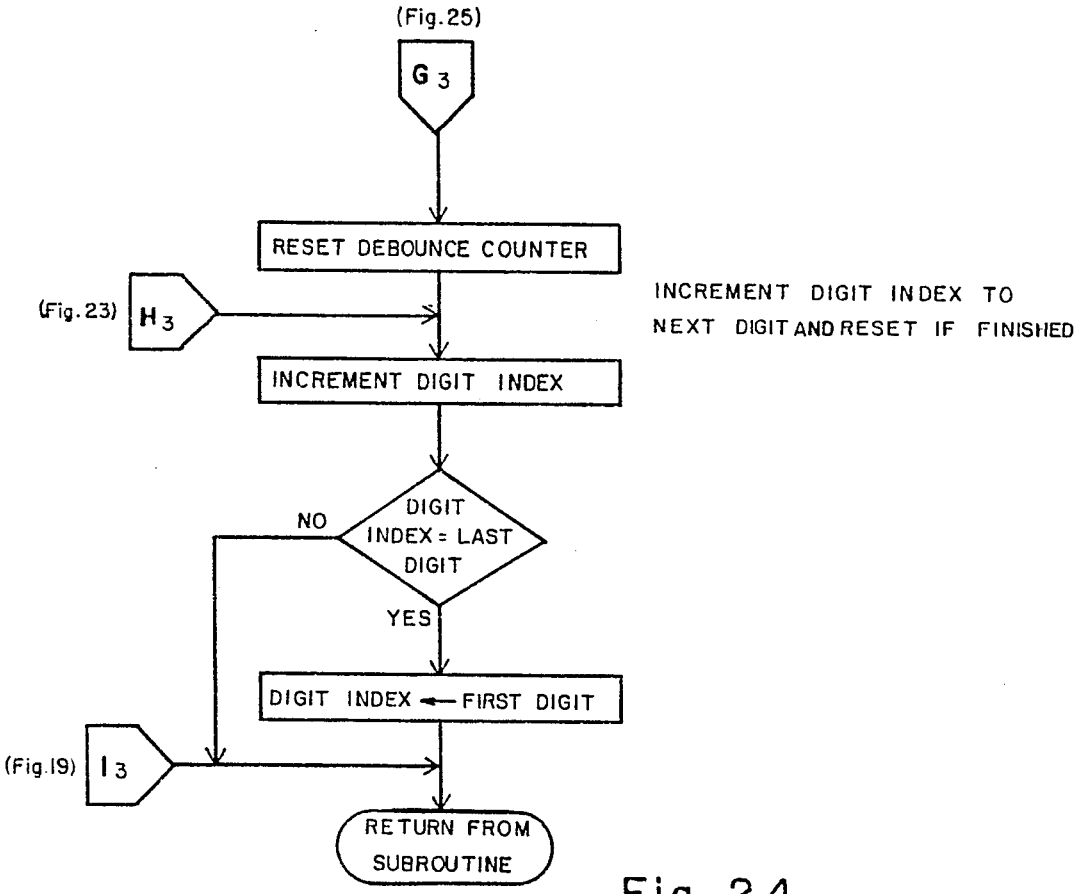

The routine then proceeds to the key detect and debouncing routine of FIGS. 23 and 24, depending upon whether the same key had been previously detected as being pressed on either inputs G3 or E3 as shown. The key detecting and debouncing routine of FIGS. 23 and 24 is a fairly standard routine, and accordingly is not described in detail herein. At the end of the routine of FIG. 24, the background routines of FIGS. 19 through 24 is exited. As noted hereinabove, these background routines are repeated every 0.001 seconds.

FIGS. 25, 26 and 27 represent the 01 numeric display routine, the 02 modify display routine, and the 03 drill running state routines of FIG. 17. In the 01 numeric display routine, the number to be displayed is converted into 3 bit decimal numbers, which are then decoded and drive the LED displays. In the 02 modify display routine, the modify byte at the modify index is multiplied by five, the resultant number is converted into 3 bit decimal numbers which are then decoded and drive the LED displays. In the 03 drill running state routine, the status of a run flag is checked, if it is not set to run, the routine exits. In review, each XROM cartridge contains a number of drills, each of which consists of a number of sequential commands to the end. At the end, a new random command (FIG. 18) is selected, so the drill starts at some random state in the middle thereof and then proceeds to the end, after which a new random command is entered, etc., until the expiration of the drill time period.

Referring to FIGS. 28 to 38 which represent the processing of the corresponding keystrokes, an example will serve to illustrate how the users' requests to select, modify, run, pause, and stop a drill are satisfied.

Upon system initialization (FIGS. 12–16) the following default parameters exist: mode-idle, run flag=running, drill state=warm up, skill level=beginner, drill duration=1 minute, and drill #=1. The user presses the "advanced" key which is detected, debounced, and passed to the foreground program main loop (FIG. 17) by the background task (FIGS. 19–24) . A key-jump table "KEYJTB" causes program execution to resume at "ADV" which merely changes the skill level to "advanced" (=2). It can readily be seen that all of the skill level modifers—beginner/intermediate/advanced—cause similar re-assignments of the skill level flag "skill", which serves to change the SROM index at run time.

Figure 29:
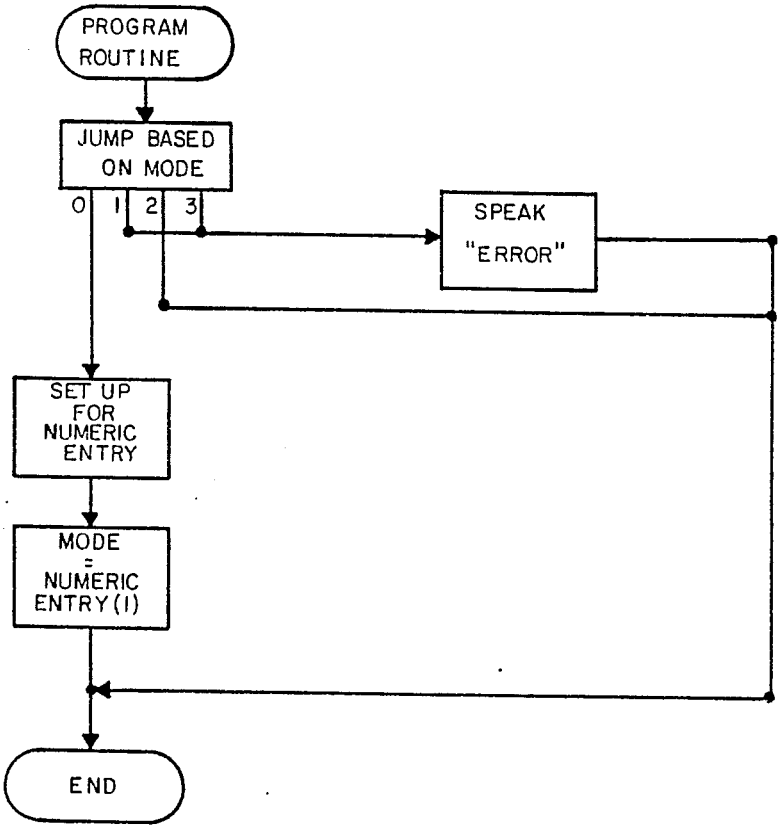
Figure 31:
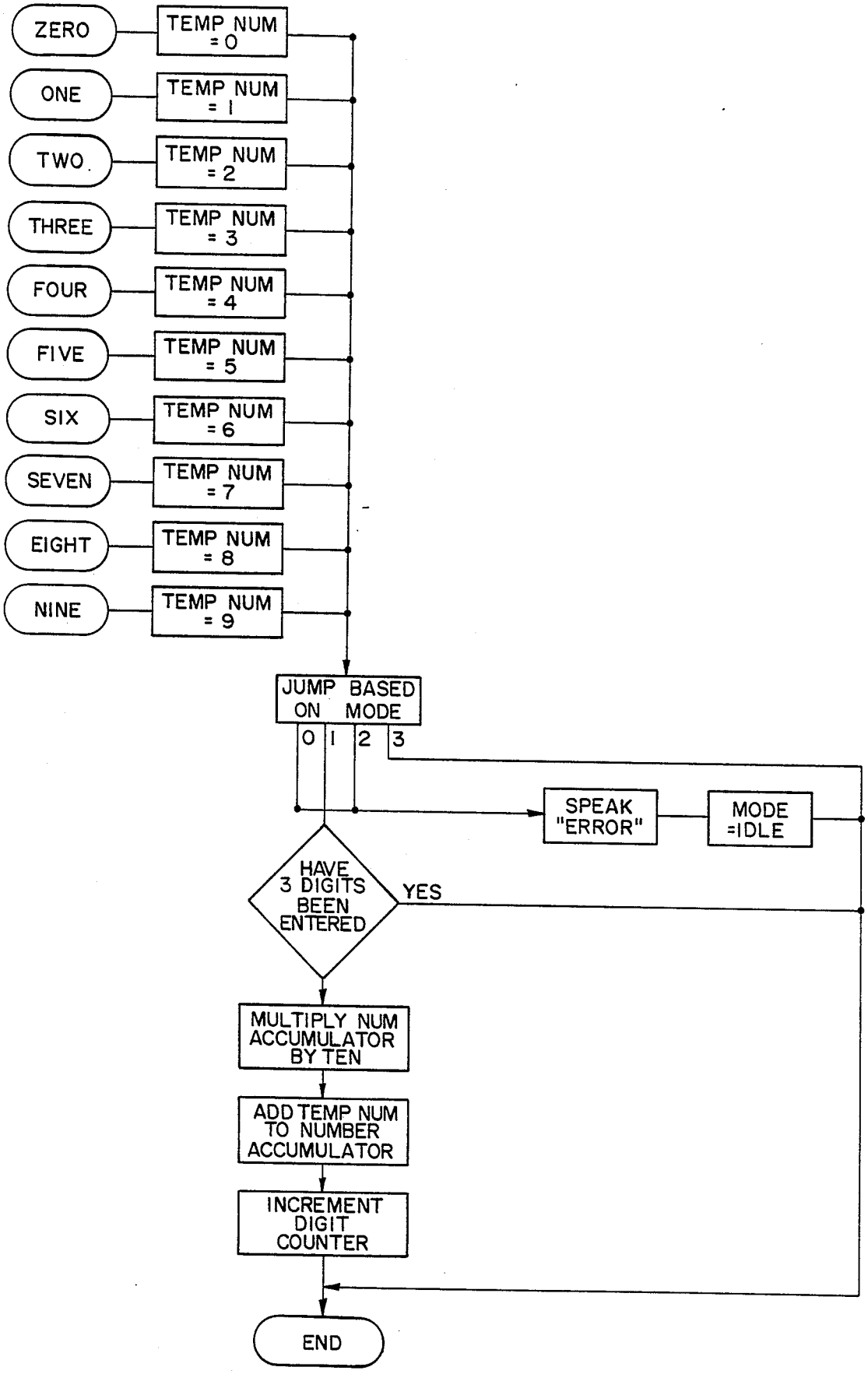
Figure 33:
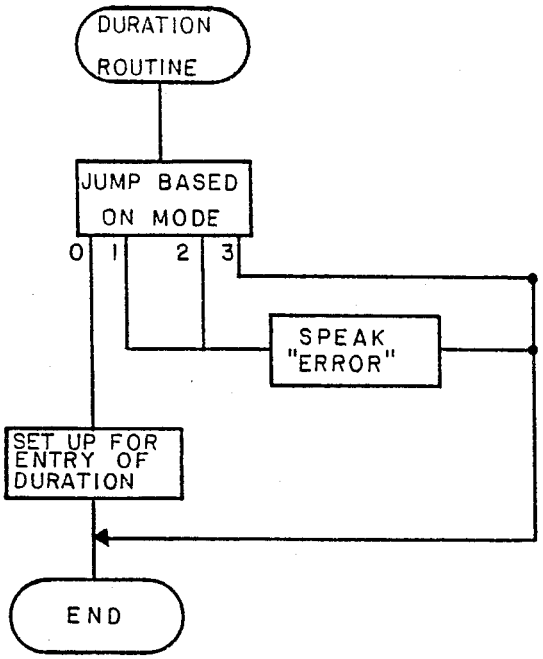
Figure 32:
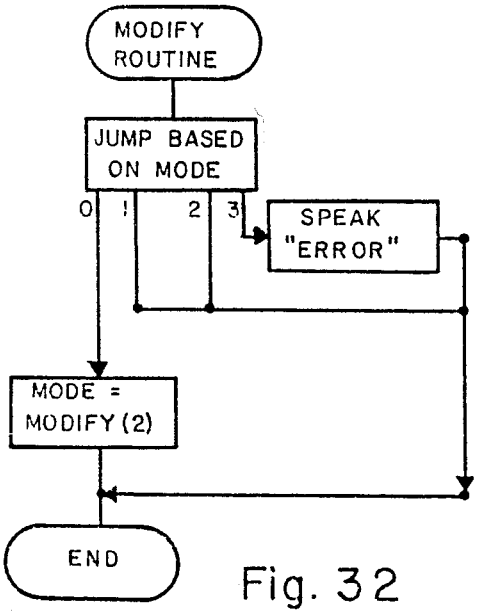
Figure 34:
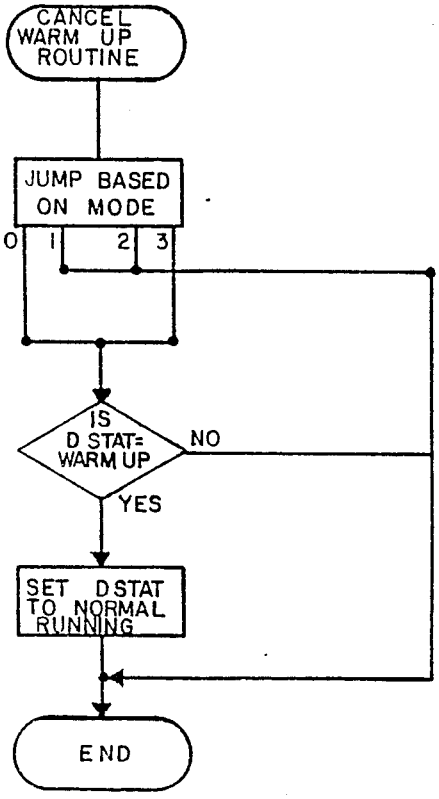
Figure 35:
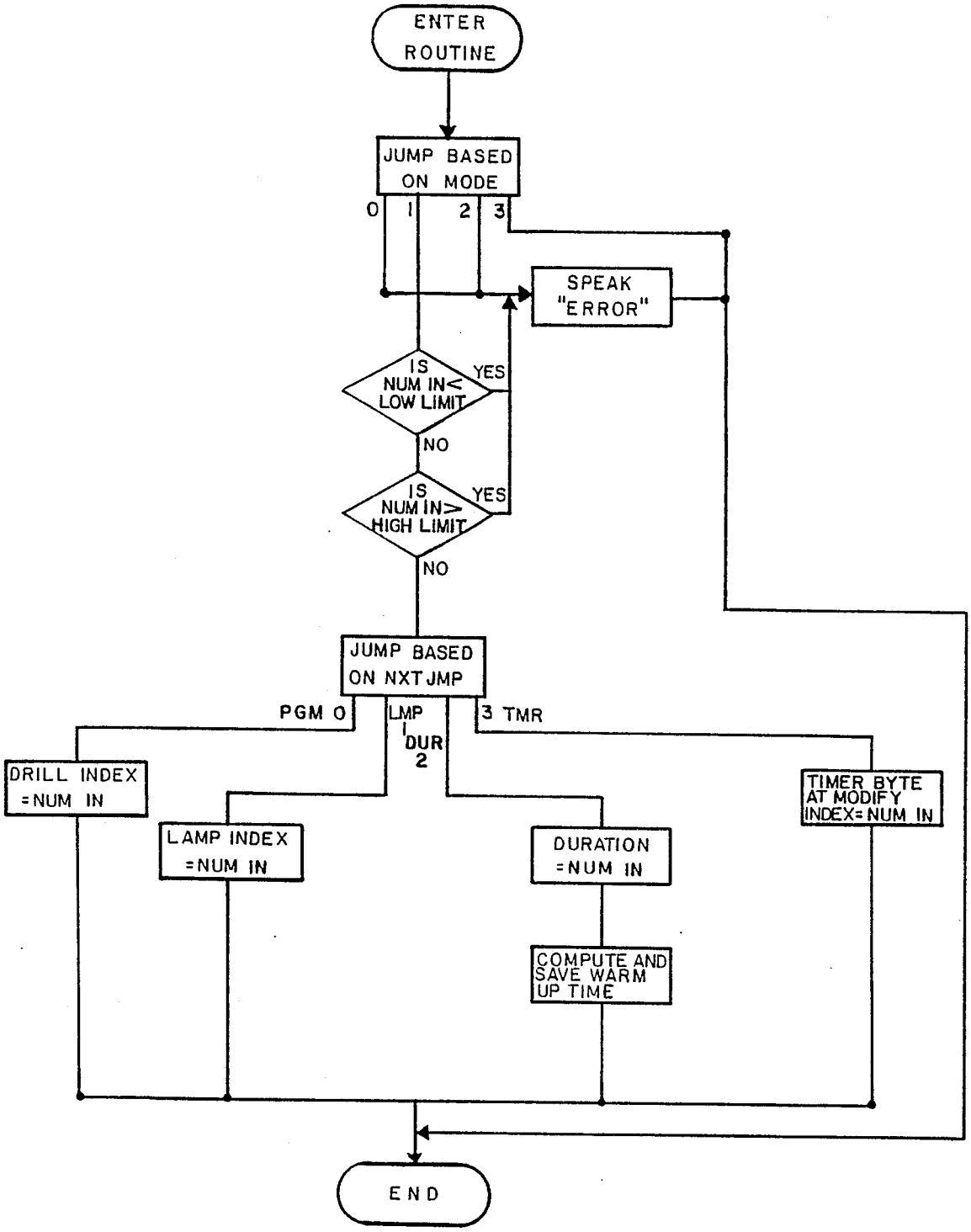

The user then decides to forfeit the warm-up period and does so by pressing the CANCEL WARM-UP KEY causing the main loop (FIG. 17) to direct the program to cancel the warm-up. (FIG. 29, case #19). A test is then made for the valid modes, idle or drill, which permit the cancellation of the warm-up drill by changing the drill state from "warm-up" to "normal".

Next the user decides to select drill #4 from the XROM which he does by first depressing the "program" key forcing an exit from the main program loop to the "prog" routine . A test is then made for the valid current mode of "idle", which permits the "prog" routine to prepare for subsequent entry of the drill # as follows. The minimum and maximum drill # limits are set, the program mode is changed from "idle" to "entry", the entry type flag is set to "program", and the temporary digit entry number is set to 0. The user then enters the digit 4 from the keyboard, causing execution to resume at the numeric processor "four", which like its counterparts "zero . . . nine", change the temporary digit entry number and test for the valid mode of "entry". Numeric entries of more than one digit would simply cause the previous entry to be adjusted through multiplication by ten and the result added to the entered digit. In this manner a maximum of three digits may be processed, with a digit counter incremented upon receipt of each digit, and the background task displaying the running total (in the example "004") via the routine in FIG. 22.

The user must then terminate his numeric entry by depressing the "enter" key, forcing the main loop to pass control to the "enter" program. A test is made for the valid "entry" mode, which if satisfied causes an additional limit check of the entered value as per the minimum and maximum numbers mentioned above. Finally, the "enter" program decides which field (drill-/lamp/duration/timer) is to be replaced with the entered value based on the flag previously set to "program". The mode is then reset to "idle", and the LED inhibit flag set before the main program loop is reentered. Note that at any time prior to pressing the "enter" key the user can delete the current numeric entry by pressing the "clear" key which invokes the "clear" routine to reset the temporary digit entry number to zero.

Next the user decides he would like to extend the "on time" of all the lamps in the selected drill by 10%. This is done by first pressing the "modify" key, causing the main loop to transfer control to the "modify" routine. This routine checks that the current mode is "idle" and changes it to "modify". Depressing the "all lamps" key transfers control to the all lamps routine, which points the modify index to the "all lamps" field. It can be seen that the time/pause/lamp modifier keys work in similar manner . . . manipulating the modify index appropriately. The 10% adjustment can then be made by successive depressions of the "+5%" key. A test is made for the valid "modify" mode and, if passed, the "all lamps" field pointed to by the modify index is incremented twice for later adjustment of the lamp-on times. The "−5%" mechanism is identical, except that it successively decrements the addressed field.

Continuing our hypothetical example, the user then decides to start the selected drill (#4) by pressing the "start/stop" key causing the main loop to branch to the "start" routine. Here a test is made to see if the mode is already set to "drill" in which case the request would have been interpreted as "stop" and the mode changed to "idle". Since it is not, the "start" routine computes the XROM drill pointers based upon drill # and skill level and adjusts the starting step index based upon the random number seed. The mode is then changed to "drill" and the run/pause flag is set to "run". The system commands contained in the XROM are then executed to allow for introductory speech, instructions, etc. and the user is given an opportunity to position him/herself by virtue of an audible countdown followed by the words "ready, set, go". The selected drill is now executed, step by step, as shown in FIG. 27. The user may elect to temporarily suspend the drill by pressing the "pause" key, invoking the "pause" routine causing the run flag to be toggled from "run" to "pause" (and subsequently back to "run"), which informs the drill running routine of FIG. 27 to forego execution of the next drill step. The drill then continues running in this manner until stopped by the user as mentioned above, or upon expiration of the timer as shown in FIG. 17.

This continuation-in-part patent application is filed to cover a START system batting unit designed particularly for the development of baseball hitting and practice drills. In different embodiments of the invention, the batting unit can be supplied with an XROM cartridge which is plugged into port 312, or a specially designed START system could be supplied having the necessary programming instructions for the batting unit and drill already in memory, for instance in firmware, in the unit.

FIG. 36 illustrates a basic START system batting unit with several batting tees positioned relative to a designated home plate, and also illustrates the photosensor circuits for detecting the hitting of a baseball off each tee. Referring thereto, the START system batting unit includes at least one variable position batting tee 400 that allows a ball 402 to be placed thereon to simulate various positions of a thrown pitch, and a START system unit 404 that prompts the batter to swing at a particular tee position. The positioning of the tee and the height adjustment allows the user to select and simulate virtually any position of a thrown ball e.g. low outside, high inside, etc. The tee 400 is preferably vertically adjustable to position the ball 402 at different vertical heights, as for example by being constructed with inner and outer elastic concentric tubes 406,408 respectively which are releasably positionable with respect to each other. The tee is equipped with a sensor and associated electronics 410 that detects the exact instant when the ball is struck by the batter to allow a determination as to whether or not the batter struck the ball in a given time period allotted by the START system program.

In one particular embodiment the batting tee sensor is connected to the START system by a cable 412 that plugs into the expansion port 372 thereof. The sensor is scanned by the START system to determine when the batter struck the ball, to allow a determination as to whether the actual swinging time is within the allotted time period.

The START system audibly alerts the user as to whether or not he was successful in beating the programmed time period, which could be the presence or absence of an acoustical signal or the use of dual tone audio signals as described herein. Hitting the ball within the time period causes a tone of given frequency to be generated, while hitting the ball outside of the time period causes a different distinguishable tone to be generated.

The hitting unit consists of the following elements:

1. Home plate—a home plate 414 with markings 416 that define the position of various pitches in the horizontal plane, e.g. inside strike, outside strike, etc. In an alternative embodiment, the home plate 415 with markings 416 can be marked on a larger mat. Moreover, the home plate or the larger mat can also be provided with plurality of positioning apertures therein, provided to assist in properly positioning a batting tee 400 at different positions thereon.

2. Batting tee(s)—two (2) batting tees 400 that may be placed on the home plate markings and that are adjustable in height to simulate various pitches; e.g. low, belt high, high.

3. START batting unit—a modified START system 404 containing a program enhancement that scans the batting sensor to determine the instant contact is made with the ball, thereby alerting the user via audible tones if he hit the ball within the allotted time period.

During operation, the batting tees are adjusted to selectable heights, and a ball is placed on the top of each tee. The tees are placed in the desired locations with respect to home plate to simulate the desired types of pitches.

The START system is placed a several yards in front of the batter, and the proper program parameters and speeds are selected to simulate the desired speed of pitch. In different alternatives, the selected input parameter could be a given time period (which corresponds to a given speed pitch), or could be a given pitch speed directly. The batter is instructed that the three top lights are used and their corresponding meanings can be as follows:

1. Top left-swing at the ball placed on the tee closest to a righthanded batter.

2. Top right-swing at the ball placed on the tee furthest from a righthanded batter.

3. Middle-back away from the pitch as if a "knockdown" pitch were thrown.

A training person simulating a pitcher can position himself behind the START unit and simulates the motion of a pitcher, and also presses the remote control switch 132 at an appropriate point in the wind-up. This causes a timed lamp to illuminate, prompting the batter to take the indicated appropriate action. If the batter hits the ball within the allotted time period (e.g. corresponding to an 85 mph fastball), a given success tone is generated. If the batter does not react quickly enough and is beaten by the programmed speed, another distinguishable failure tone is generated.

The person simulating the pitcher can also train the batter to "take" (i.e. not swing at) a pitch by performing the wind-up and not pressing the remote control button.

FIG. 37 illustrates the basic principle of operation of the START system batting unit sensor. A photoelectric light sensor 420 is placed near the bottom of an opaque batting tee, and is adjusted to react positively (turn on) to the ambient light, which is directed to the sensor through the top of the opaque batting tee. The ball is placed on top of the batting tee, interrupting the light source from activating the photosensor, thereby turning it off. When the ball is struck by the batter (in response to the START system lamps), the ambient light again activates the photosensor, providing an electronic indication that the batter has struck the ball. The photosensor signal is coupled to the START system through the cable 412, and the signals therefrom are scanned to determine if the ball was struck within the pre-programmed allotted time period.

FIG. 37 illustrates a circuit block diagram of the photo sensor electronics. The signal level of the electrical output signal of the photosensor 420 is directly proportional to the amount of light reaching the sensor. This signal level is one of the inputs of a comparator circuit 422. The other input to the comparator circuit s an ambient light adjustment signal that allows the user to manually adjust a potentiometer 424 to adjust the sensitivity of the sensor to the surrounding light conditions and reduces the effects of different lighting environments on the circuit. For example, the unit may be used indoors with the effects of artificial light on the sensor, or outdoors with the effects of sunlight. The circuit is designed so as not to be affected by most lighting conditions, and the manual adjustment is provided as an effective over-ride only for extreme lighting conditions.

The manual adjustment is provided by the potentiometer 424 that is adjusted until an adjustment LED 426 illuminates; i.e. the ambient light energizes the output of the photosensor to a more positive voltage than that of the adjustment potentiometer, thereby turning on the comparator. An output signal from a buffer inverter 428 on the sensor lead will then be at a logical zero state. The ball is placed on the top of the tee, interrupting the light, and the comparator switches states. The lamp turns off and the sensor lead becomes a logical one state.

When the ball is struck, and the ambient light again energizes the sensor, the comparator/buffer inverter again switches states causing the START system to detect the instant when the ball was struck from the tee.

FIG. 22 illustrates a block diagram of the major components of the microprocessor controlled START system, and the functions of the address and control busses are explained with reference thereto. The batting tee sensor appears as a discrete input lead to the unit via the expansion port 372 of FIG. 11. This lead is addressable and readable by the microprocessor as described herein with reference to other inputs to the microprocessor.

The operation of the START system with the batting sensor is similar to the standard functioning of the unit until the lamp time expires. At this point, instead of sounding an audible tone unconditionally, the microprocessor firmware first scans the batting sensor lead to determine the logical state thereof. A logical one state indicates that the ball has not been struck, while a logical zero state indicates that it has been struck. The condition of this lead at that point in time causes the firmware to output one of two tones at different frequencies corresponding to the state of the lead, thereby giving the batter instant feedback concerning his ability to beat the allotted time period.

Figure 38:
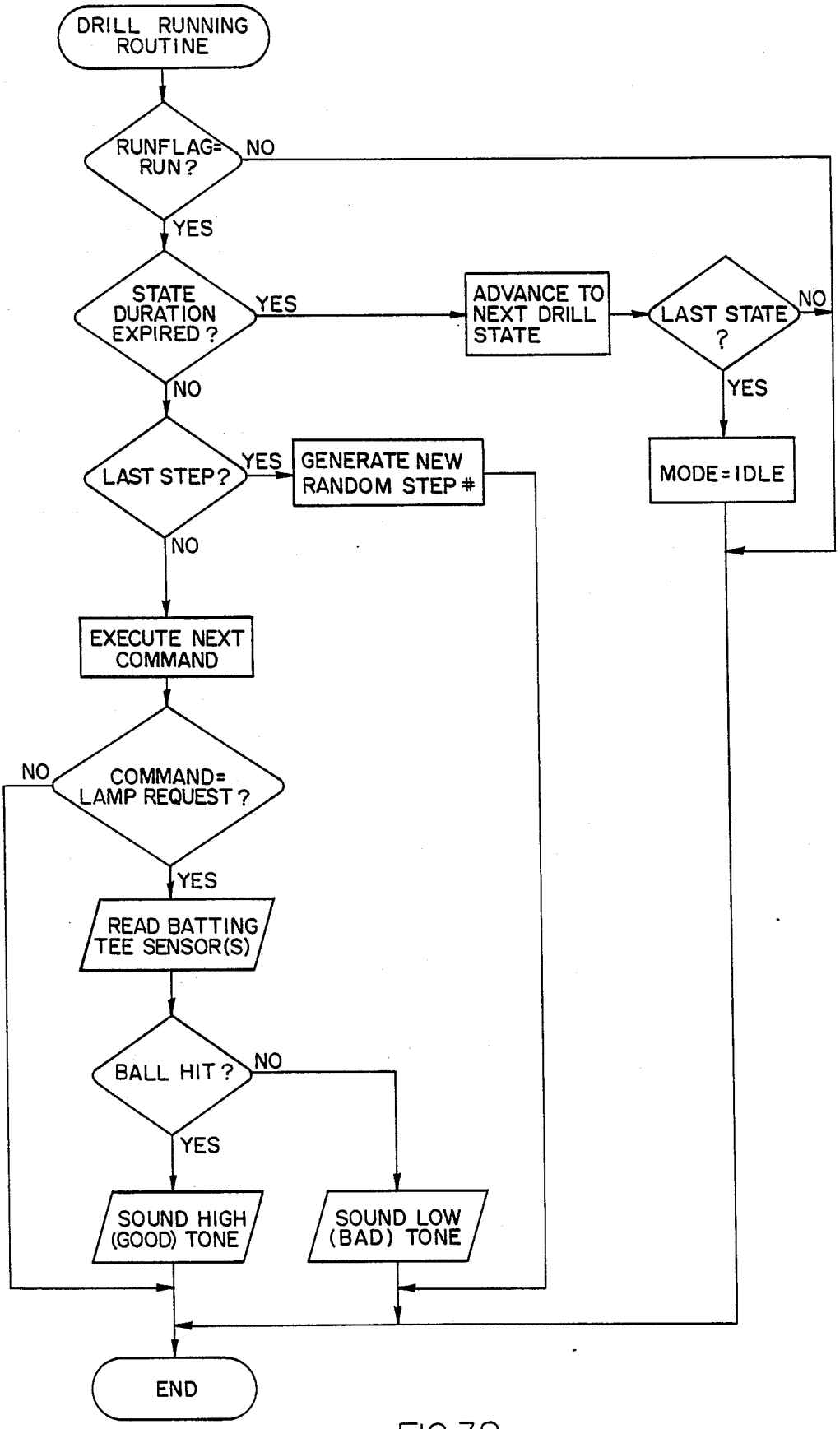
FIG. 38 illustrates an exemplary logic flow diagram for software suitable for controlling and running the START system batting unit.

FIG. 38 illustrates an exemplary logic flow diagram for software suitable for controlling and running the START system batting unit. The program is straightforward, advancing through the drill steps, selectively activating the lamps, reading the batting tee sensor(s), and audibly sounding a high or low tone to signal success or failure.

While several embodiments and variations of the present invention for a START system batting unit are described in detail herein, it should be apparent that the disclosure and teachings of the present invention will suggest many alternative designs to those skilled in the art.

What is claimed is:

1. A method for technique and accelerated reaction training of a batter in a programmable batter training program, comprising:

a. defining a plurality of different batting reaction patterns to be executed by the batter by the selective energization of one of an array of lights positioned visibly in front of the batter, with each light signifying a different particular batting reaction pattern to be executed by the batter, and at least one of the batting reaction patterns to be executed in a selectable programmed time period, and selectively setting the programmed time period to be either faster or slower;

b. providing to the batter at least one batting tee with a ball placed thereon, such that the batter can address the ball placed on the batting tee during the batter training program;

c. selectively energizing one light of the array at a time, signifying a particular batter reaction pattern to be executed in a sequence of energizing of the array of lights unknown to the batter undertaking the batter training program, with the sequence of lighting of the array appearing to be random to the batter, such that the batter waits for an unknown light to be energized, and then reacts with a particular batter reaction pattern to be executed, with at least one batter reaction pattern being the hitting of the ball placed on said batting tee within the programmed time period;

d. determining the hitting of the ball off of the batting tee, and whether the actual time period of batting response from the energization of the light to the hitting of the ball off of the batting tee is within the programmed time period; and e. selectively activating an acoustic transducer at the end of the programmed time period to audibly signal to the batter whether or not the batter has hit the ball off of said tee within the said programmed time period of response.

2. A method for technique and accelerated reaction training of a batter in a batter training program as claimed in claim 1, further including activating the acoustic transducer with one type of sound when the batter has hit the ball off of the tee within the programmed time period of response, and activating the acoustic transducer with a second and different type of sound when the batter has failed to hit the ball off of the tee within the programmed time period of response.

3. A method for technique and accelerated reaction training of a batter in a batter training program as claimed in claim 2, including activating the acoustic transducer with a first frequency sound tone when the batter has had the ball off of the tee within the programmed time period of response, and activating the acoustic transducer with a second, and different frequency sound tone when the batter has failed to hit the ball off of the tee within the programmed time period of response.

4. A method for technique and accelerated reaction training of a batter in a batter training program as claimed in claim 1, including providing two variable height batting tees for the batter, with each batting tee being positioned differently with respect to a home plate, and each batting tee having one light of the array of lights associated therewith, such that when a particular light associated with a particular batting tee is energized, the batter reacts by attempting to bat the ball off of that particular batting tee.

5. A method for technique and accelerated reaction training of a batter in a batter training program as claimed in claim 1, further including providing a trainer simulating a pitcher in front of the batter, and said trainer activating a remote switch during the pitching wind-up to energize one light of the array of lights.

6. A method for technique and accelerated reaction training of a batter in a batter training program as claimed in claim 1, wherein said step of determining includes detecting the time of hitting of a ball off of said tee by utilizing a photosensor positioned with an opaque batting tee, with the photosensor detecting ambient light incident thereon in response to the ball being hit off of the tee to detect the hitting of the ball.

7. A method for technique and accelerated reaction training of a batter in a batter training program as claimed in claim 6, further including providing a circuit adjustment to adjust the sensitivity of the photosensor to ambient light.

8. A system for technique and accelerated reaction training of a batter in a programmable batter training program, comprising:

a. an array of lights to be positioned visibly in front of the batter, with each light signifying a different particular batting reaction pattern to be executing by the batter, with at least one of the batting reaction patterns to be executed in a selectable programmed time period;

b. at least one batting tee with a ball placed thereon, such that the batter can address the ball placed on the batting tee during the batter training program;

c. a detector means for the at least one batting tee for detecting the hitting of the ball off said batting tee;

d. a control system for selectively energizing one light of the array at a time, signifying a particular batter reaction pattern to be executed, in a sequence of energizing of the array of lights unknown to the batter undertaking the batter training program, with the sequence of lighting of the array appearing to be random to the batter, such that the batter waits for an unknown light to be energized, and then reacts with a particular batter reaction pattern to be executed, with at least one batter reaction pattern being the hitting of the ball off of said batting tee within the programmed time period, said control system being programmable to enter different programmed time periods of response, either faster or slower, and said control system also being coupled to said detector means for determining whether the actual time period of batting response is within the programmed time period; and e. an acoustic transducer selectively activated by said control system to audibly signal to the batter whether or not the batter has hit the ball off of said tee within said programmed time period of response.

9. A system for technique and accelerated reaction training of a batter in a batter training program as claimed in claim 8, wherein said control system activates the acoustic transducer with one type of sound when the batter has hit the ball off of the tee within the programmed time period of response, and activates the acoustic transducer with a second type of sound when the batter has failed to hit the ball off the tee within the programmed time period of response.

10. A system for technique and accelerated reaction training of a batter in a batter training program as claimed in claim 9, wherein said control system activates the acoustic transducer with a first sound tone when the batter has hit the ball off the tee within the programmed time period of response, and activates the acoustic transducer with a second and different sound tone when the batter has failed to hit the ball off of the tee within the programmed time period of response.

11. A system for technique and accelerated reaction training of a batter in a batter training program as claimed in claim 8, including two variable height batting tees with each batting tee being positioned differently with respect to a home plate, and each batting tee having one light of the array of lights associated therewith, such that when a particular light associated with a particular batting tee is energized, the batter reacts by attempting to bat the ball off of that particular batting tee.

12. A system for technique and accelerated reaction training of a batter in a batter training program as claimed in claim 11, further including a remote switch for activating said control system such that a trainer simulating a pitcher in front of the batter activates said remote switch during the pitching wind-up to energize one light of the array of lights.

13. A system for technique and accelerated reaction training of a batter in a batter training program as claimed in claim 1, wherein said detector means includes a photosensor positioned within an opaque batting tee, with the photosensor detecting ambient light incident thereon in response to the ball being hit off of the tee to detect the hitting of the ball.

14. A system for technique and accelerated reaction training of a batter in a batter training program as claimed in claim 13, further including an adjustable circuit for regulating the sensitivity of the photosensor to ambient light.

* * * * *